US008171768B2

(12) United States Patent
Ueno et al.

(10) Patent No.: US 8,171,768 B2
(45) Date of Patent: May 8, 2012

(54) COMPOSITE MOLD, PLASTIC WORKING DEVICE FOR WORKPIECE MATERIAL, AND PLASTIC WORKING METHOD FOR WORKPIECE MATERIAL

(75) Inventors: Hiroshi Ueno, Tondabayashi (JP); Satoshi Hashimoto, Kyoto (JP); Alexei Vinogradov, Osaka (JP)

(73) Assignees: JTEKT Corporation, Osaka (JP); Satoshi Hashimoto, Kyoto (JP); Alexei Vinogradov, Osaka (JP)

( * ) Notice: Subject to any disclaimer, the term of this patent is extended or adjusted under 35 U.S.C. 154(b) by 1043 days.

(21) Appl. No.: 12/091,696

(22) PCT Filed: Oct. 31, 2006

(86) PCT No.: PCT/JP2006/321745

§ 371 (c)(1),
(2), (4) Date: Apr. 25, 2008

(87) PCT Pub. No.: WO2007/052654

PCT Pub. Date: May 10, 2007

(65) Prior Publication Data

US 2009/0120154 A1 May 14, 2009

(30) Foreign Application Priority Data

Oct. 31, 2005 (JP) ..... 2005-316832

(51) Int. Cl.
*B21C 23/00* (2006.01)
*B21C 23/01* (2006.01)
*B21D 22/00* (2006.01)

(52) U.S. Cl. ..... 72/256; 72/264; 72/352; 72/358

(58) Field of Classification Search ..... 72/253.1, 72/256, 264, 265, 273, 352, 353.2, 354.6, 72/355.4, 357–359, 467
See application file for complete search history.

(56) References Cited

FOREIGN PATENT DOCUMENTS

| | | |
|---|---|---|
| JP | 2003-001321 | 1/2003 |
| JP | 2004-167507 | 6/2004 |
| JP | 2005-271044 | 10/2005 |

OTHER PUBLICATIONS

English translation of the International Preliminary Report on Patentability mailed May 15, 2008 in corresponding PCT Application No. PCT/JP2006/321745.

*Primary Examiner* — Teresa Ekiert
(74) *Attorney, Agent, or Firm* — Nixon & Vanderhye P.C.

(57) ABSTRACT

After a rod-like titanium material 20 is accommodated in a generally linear-shaped groove 13 of a first mold 7, a first guide portion 15 of a second mold 8 is fitted to the groove 13. Thereafter, the first mold 7 is moved along an arrow A direction relative to the second mold 8 fixed to an anchor block, by which the titanium material 20 substantially immovably retained in the groove 13 of the first mold 7 is bent and pushed into a through hole 24 of the second mold 8 by the first guide portion 15, thus being plastically deformed.

21 Claims, 13 Drawing Sheets

COMPOSITE MOLD, PLASTIC WORKING DEVICE FOR WORKPIECE MATERIAL, AND PLASTIC WORKING METHOD FOR WORKPIECE MATERIAL

This application is the U.S. national phase of International Application No. PCT/JP2006/321745, filed 31 Oct. 2006, which designated the U.S. and claims priority to Japan Application No. 2005-316832, filed 31 Oct. 2005, the entire contents of each of which are hereby incorporated by reference.

TECHNICAL FIELD

The present invention relates to a composite mold, a plastic working device for workpiece material and a plastic working method for workpiece material for performing, for example, so-called ECAP (Equal Channel Angular Pressing) process or the like.

BACKGROUND ART

When a material is subjected to a severely large compressive force so as to be bent and resultantly plastically deformed (i.e. so-called ECAP process), the material is micro-fined in crystal grain size with its strength dramatically improved. With a material of pure titanium as an example, its crystal grain size can be subdivided to about one thousandth so that the strength is improved by leaps and bounds. In particular, the ECAP process allows strength improvement to be achieved without alloying, thus being valuable. For example, a pure metal such as the plastically deformed pure titanium may preferably be used as a material of artificial teeth for use in implant techniques because it scarcely harms the human body.

A conventionally available plastic working method for performing the ECAP process is disclosed in JP 2003-1321 A. This method includes plastic working of a workpiece material by using a mold in which a generally U-shaped passage is formed. More specifically, in this method, the head of a rod-like workpiece material having a cross-sectional shape generally identical to a cross-sectional shape of the passage is inserted into the passage through one opening of the passage, and thereafter an end face of the rod-like workpiece material on its one side opposite to its insertion side is pressed by a plunger or the like with a severely high pressure of several hundreds of tons or so, so that the rod-like workpiece material is passed through a bent portion of the U-shaped passage. During the passage of the workpiece material through the bent portion, the workpiece material is forcedly changed in its extending direction, thereby causing a severe shearing force and an accompanying severe strain to occur to the workpiece material in the passage of the workpiece material through the bent portion. In this way, by imparting severe plastic deformation to the workpiece material, the workpiece material is abruptly micro-fined in crystal grain size, by which material characteristics of the workpiece material are improved.

Unfortunately, with the conventional method described above, since the workpiece material is moved in the U-shaped passage by applying pressurizing force to the end face of the rod-like workpiece material having a cross-sectional shape generally identical to the cross-sectional shape of the U-shaped passage, the workpiece material is laterally strained in proportion to Poisson's ratio by the pressing force, i.e., the workpiece material is stretched perpendicularly to the extending direction of the workpiece material, so that a dynamic frictional force between the workpiece material and the passage wall surface becomes enormously large. This causes the mold to be early worn or damaged, leading to a problem that the mold life is very short.

Also, because of the enormously large dynamic frictional force between the workpiece material and the passage wall surface as described above, the force required to move the workpiece material in the U-shaped passage becomes very large. This causes a problem that an apparatus for plastically deforming the workpiece material or energy cost for driving the apparatus is very large.

Another plastic working method for performing the ECAP process is disclosed in JP 2004-167507 A. This method employs a mold in which an L-shape bent material passage is formed. This mold is a single mold formed by integrally joining two parts together to form an L-shaped passage. In this method, a workpiece material is inserted through one opening of the L-shaped material passage, thereafter an end face of the workpiece material on its one side opposite to its insertion side is pressurized by a pressure device to make the workpiece material extruded from the other opening of the material passage, so that the workpiece material is micro-fined in crystal grain size by the bent portion of the material passage, thereby improving the material characteristics of the workpiece material.

However, with this method also, since the workpiece material is pressurized from its one end, the workpiece material is laterally strained, so that a dynamic frictional force between the workpiece material and the material passage becomes enormously large. This causes such problems as the mold's shorter life and very high cost due to the large pressing force for the plastic deformation of the workpiece material.

SUMMARY OF THE INVENTION

Accordingly, an object of the present invention is to provide a composite mold which is capable of micro-fining the crystal grain size of a workpiece material and which is much longer in life than conventional counterparts. A further object of the present invention is to provide a plastic working device for workpiece material, as well as a plastic working method for workpiece material, both of which are much longer in mold life and much lower in cost for the micro-fining of the crystal grain size of the workpiece material, as compared with conventional counterparts.

In order to achieve the above object, according to the present invention, there is provided a composite mold comprising:

a first mold having a groove which retains a generally linear-shaped workpiece material and which is formed at least partly into a generally linear shape; and a second mold which has a first guide portion to be relatively movably fitted to the groove, and which has a body portion having a through hole intersecting and communicating with the groove, wherein with the first guide portion fitted to the groove, the first mold and the second mold are movable relative to each other in a generally linearly extending direction of the groove, and the first guide portion acts so that the workpiece material substantially immovably retained in the groove of the first mold is bent and guided from the groove to the through hole by relative movement of the first mold to the second mold.

The first mold may have, for example, a generally L-shaped groove with a generally linear-shaped portion.

According to this invention, by relative movement of the first mold to the second mold, the first guide portion acts so that the workpiece material substantially immovably retained in the groove of the first mold is bent and guided from the groove into the through hole. Therefore, a severely large shearing force can be given to the workpiece material by the bending at around the first guide portion, so that the crystal grain size of the workpiece material can be micro-fined. Thus, material characteristics (strength, durability and the like of the material) after the working of the workpiece material can be greatly improved.

Also, according to this invention, since the workpiece material is scarcely moved relative to the first mold, the first mold can be substantially completely prevented from occurrence of damage due to frictional contact involved in the relative movement to the workpiece material.

Also, according to this invention, since the workpiece material substantially immovably retained in the groove of the first mold is bent by the first guide portion and guided from the groove to the through hole by relative movement of the first mold to the second mold, relatively moving part of the workpiece material can be reduced, as compared with conventional cases, by an extent corresponding to the size of the groove so as to be restricted roughly only to the part of the through hole, and moreover parts on which large force acts can be restricted roughly to proximities to the first guide portion of the second mold as well as to the through hole. Accordingly, occurrence of damage of the composite mold in this invention can be suppressed to a large extent, as compared with conventional molds in which the whole passage moves relative to the workpiece material, and the life of the composite mold can be greatly prolonged as compared with those of conventional molds.

Also, according to this invention, most part of the relative movement force of the first mold and the second mold can be utilized as part of the force for reducing the grain size of the workpiece material. That is, according to this invention, the frictional force between the wall surface of the groove and the side faces of the workpiece material can be reduced to a large extent, unlike conventional molds in which frictional force between the wall surface of the groove and the side faces of the workpiece material makes the culprit of various problems. Therefore, the pressurizing force to be applied to the workpiece material can be reduced to a large extent, as compared with conventional molds which require pressurizing forces that overcome the frictional force between the workpiece material and the mold wall surface due to the force for pushing the workpiece material against the mold wall surface. Thus, cost for plastic deformation of the workpiece material can be reduced to a large extent.

Also, in one embodiment, the groove of the first mold, a surface of the second mold on one side confronting the groove, and the first guide portion form a closed space that closes widthwise directions and at least longitudinal one end of the generally linear-shaped workpiece material, and a surface of the first guide portion confronting the closed space adjoins a side face of the through hole or is located near the side face.

In this embodiment, the workpiece material bent by the first guide portion can be led toward the through hole with reliability.

Also, in one embodiment, with the first guide portion fitted to the groove, a portion of the groove communicating with the through hole is constantly covered with the surface of the second mold confronting the groove.

In this embodiment, with the first guide portion fitted to the groove, the through-hole side portion of the groove retaining the workpiece material can be blocked with the groove side surface of the second mold without clearance. Therefore, the workpiece material can reliably be prevented from being released out from the groove.

Also, in one embodiment, the first guide portion is a protruding portion that protrudes from the body portion, and a side face portion of the first guide portion for bending the workpiece material is an extension surface of part of a side face of the through hole.

In this embodiment, since the side face portion of the first guide portion for bending the workpiece material is the extension surface of part of the side face of the through hole, the workpiece material bent by the first guide portion can be pushed into the through hole smoothly.

Also, in one embodiment, the through hole extends generally linearly, and an extending direction of the groove generally perpendicularly intersects the extending direction of the through hole.

In this embodiment, since the extending direction of the groove generally perpendicularly intersects the extending direction of the through hole, plastic deformation of an about 90-degree angle can be applied to the workpiece material, so that the workpiece material can be subjected to the most effective plastic deformation. Therefore, the grain size of the workpiece material can be reduced most efficiently. Further, for example, in the case where the workpiece material is pure titanium, the workpiece material can be improved about twice higher in strength and about 100 times higher in durability by the plastic deformation.

Also, one embodiment comprises a third mold having a groove which retains the generally linear-shaped workpiece material and which is formed at least partly into a generally linear shape, wherein the second mold has a second guide portion to be relatively movably fitted to the groove of the third mold, and the groove of the third mold communicates with an opening of the through hole on its one side opposite to a first mold side.

The third mold may have, for example, a generally L-shaped groove with a generally linear-shaped portion.

In this embodiment, the workpiece material retained in the groove of the first mold can be pushed into the groove of the third mold via the through hole. Also, the workpiece material pushed into the groove of the third mold can once again be pushed into the first mold via the through hole. Thus, by reciprocating the workpiece material a desired number of times between the first mold and the third mold, desired material characteristics after the working of the workpiece material can be achieved with simplicity and low cost.

Also, in one embodiment, the second guide portion is a protruding portion that protrudes from the body portion.

Also, in one embodiment, part of a side face of the second guide portion is an extension surface of part of a side face of the through hole.

In this embodiment, since part of the side face of the second guide portion is the extension surface of part of the side face of the through hole, the workpiece material that has passed through the through hole can be smoothly pushed into the groove of the third mold along the side face of the second guide portion.

Also, in one embodiment, the through hole is generally constant in cross-sectional shape and extends generally linearly, the second mold is so shaped as to be generally plane symmetrical with respect to a perpendicular bisector plane of the through hole that stretches along a direction perpendicular to the extending direction of the through hole, and the first mold and the third mold are generally identical in shape to each other.

In this embodiment, since the through hole extends generally linearly, the workpiece material can be passed smoothly through within the through hole. Also, since the first mold and the third mold are generally identical in shape to each other, the first mold and the third mold can be mass produced, so that the manufacturing cost for the composite mold can be reduced.

Also, in one embodiment, the through hole has a generally rectangular cross-sectional shape, and a side face portion of the first guide portion for bending the workpiece material, part of a side face of the through hole, and part of a side face of the second guide portion are generally flush with one another.

In this embodiment, the workpiece material retained by the groove of the first mold can be easily pushed into the groove of the third mold via the through hole, and conversely, the workpiece material retained by the groove of the third mold can be easily pushed into the groove of the first mold via the through hole.

Also, in one embodiment, the first guide portion is generally rectangular parallelepiped-shaped, and a cross section of the groove of the first mold perpendicular to the extending direction of the groove has a generally rectangular cross-sectional shape.

In this embodiment, the first guide portion has a simple, generally rectangular parallelepiped shape, and a cross section of the groove of the first mold perpendicular to the extending direction of the groove has a simple, generally rectangular cross-sectional shape. Therefore, the first guide portion and the groove of the first mold can be manufactured with simplicity and low cost.

Also, in one embodiment, the first mold has a body portion in which the groove is formed, and an end portion which adjoins the body portion in an extending direction of the groove and which covers one end of the groove, and the workpiece material is substantially immovably retained in the groove of the first mold by an end face of the end portion facing the groove.

In this embodiment, the workpiece material can be pressed by the end face and, as a result of this, the workpiece material can be substantially immovably retained in the groove of the first mold with simplicity.

Also, in one embodiment, the end portion is fittable to and removable from the body portion of the first mold.

In this embodiment, since the end portion is fittable to and removable from the body portion of the first mold, removing the end portion allows the workpiece material, which is a completed product subjected to plastic deformation, to be easily extracted from the composite mold.

Also, in one embodiment, the through hole extends generally linearly and has a generally rectangular cross-sectional shape, a side face portion of the first guide portion for bending the workpiece material and a first portion of a side face of the through hole are positioned generally flush with each other, and part of a side face of the second guide portion and a second portion of a side face of the through hole generally perpendicular to the first portion are generally flush with each other.

In this embodiment, the workpiece material retained by the groove of the first mold can be easily pushed into the groove of the third mold via the through hole, and conversely, the workpiece material retained by the groove of the third mold can be easily pushed into the groove of the first mold via the through hole.

Also, in one embodiment, the through hole extends generally linearly and has a generally rectangular cross-sectional shape, and a side face portion of the first guide portion for bending the workpiece material and a first portion of a side face of the through hole are positioned generally flush with each other, and part of a side face of the second guide portion and a second portion of a side face of the through hole generally parallel to the first portion are generally flush with each other.

In this embodiment, the workpiece material retained by the groove of the first mold can be easily pushed into the groove of the third mold via the through hole, and conversely, the workpiece material retained by the groove of the third mold can be easily pushed into the groove of the first mold via the through hole.

Also, in one embodiment, the through hole extends generally linearly, and a cross-sectional shape of the groove of the first mold, a cross-sectional shape of the through hole, and a cross-sectional shape of the groove of the third mold are generally identical to one another.

In this embodiment, since the through hole extends generally linearly and since the cross-sectional shape of the groove of the first mold, the cross-sectional shape of the through hole, and the cross-sectional shape of the groove of the third mold are generally identical to one another, the frictional force between the through hole and the workpiece material can be reduced, so that the life of the composite mold can be further prolonged.

Also, in one embodiment, an extending direction of the groove of the first mold and an extending direction of the groove of the third mold generally perpendicularly intersect with an extending direction of the through hole.

In this embodiment, since the extending direction of the groove of the first mold and the extending direction of the groove of the third mold generally perpendicularly intersect the extending direction of the through hole, plastic deformation of an about 90-degree angle can be applied to the workpiece material, so that the workpiece material can be subjected to the most effective plastic deformation. Therefore, the grain size of the workpiece material can be reduced most efficiently. For example, in the case where the workpiece material is pure titanium, the workpiece material can be greatly improved about twice higher in strength and about 100 times higher in durability by the plastic deformation.

Also, in one embodiment, an end corner of the surface of the second mold on one side confronting the groove and opposite to a through hole side in the extending direction of the groove is machined for chamfering.

In this embodiment, the portion of the workpiece material that is not covered with the groove-side surface of the second mold at a start of plastic working can be smoothly pushed into the space covered with the groove of the first mold and the groove-side surface of the second mold after the start of the plastic working.

According to the present invention, there is provided a plastic working device for workpiece material, comprising:

a first mold having a groove which retains a workpiece material and which is formed at least partly into a generally linear shape;

a second mold which has a first guide portion to be relatively movably fitted to the groove, and which has a body portion having a through hole intersecting and communicating with the groove;

a first relative movement unit for moving the first mold and the second mold relative to each other so that the workpiece material substantially immovably retained in the groove of the first mold is pushed from the groove into the through hole; and a retainer unit for retaining a state that the first guide portion is fitted to the groove of the first mold.

According to this invention, the first mold can be moved relative to the second mold by the first relative movement unit, so that the workpiece material substantially immovably retained in the groove of the first mold can be bent and pushed from the groove into the through hole by the first guide portion. Therefore, a severely large shearing force can be given to the workpiece material in the bending process at around the first guide portion, so that the crystal grain size of the workpiece material can be micro-fined. Thus, material characteristics (strength, durability and the like of the material) after the working of the workpiece material can be greatly improved.

Also, according to this invention, since the workpiece material is scarcely moved relative to the first mold, the first mold can be substantially completely prevented from occurrence of damage due to the movement relative to the workpiece material.

Also, according to this invention, the relatively moving part of the workpiece material can be reduced, as compared with conventional cases, by an extent corresponding to the size of the groove so as to be restricted roughly only to the part of the through hole, and moreover parts on which large force acts can be restricted roughly to proximities to the first guide portion of the second mold as well as to the through hole. Accordingly, occurrence of damage of the first and second molds can be suppressed to a large extent, as compared with conventional molds in which the whole passage moves relative to the workpiece material, and the lives of the first and second molds can be greatly prolonged as compared with those of conventional molds.

One embodiment comprises a third mold having a groove which retains the workpiece material and which intersects and communicates with the through hole and moreover which is formed at least partly into a generally linear shape, wherein the second mold has a second guide portion to be relatively movably fitted to the groove of the third mold; and a second relative movement unit for moving the second mold and the third mold relative to each other, wherein the retainer unit retains a state that the second guide portion is fitted to the groove of the third mold.

In this embodiment, since the retainer unit retains the state that the second guide portion is fitted to the groove of the third mold, the first guide portion can reliably be prevented from being released out from the groove of the first mold during the operation of the plastic working device for workpiece material, and moreover the second guide portion can reliably be prevented from being released out from the groove of the third mold.

Also, in this embodiment, since the second relative movement unit for moving the second mold and the third mold relative to each other is included, the workpiece material pushed from the groove of the first mold via the through hole into the groove of the third mold can once again be pushed into the groove of the first mold via the through hole.

Also, in one embodiment, the second mold is immobilized, and the first relative movement unit is a pressing device for pressing the first mold so that the workpiece material retained in the groove of the first mold is pressed against the first guide portion.

Also, in one embodiment, the second mold is immobilized, and the first relative movement unit presses the first mold so that part of the groove of the first mold communicating with the through hole is shrunk, while the second relative movement unit presses the third mold so that part of the groove of the third mold communicating with the through hole is shrunk, and a pressing force with which the first relative movement unit presses the first mold is set larger than a pressing force with which the second relative movement unit presses the third mold, whereby the workpiece material retained in the groove of the first mold is moved to the groove of the third mold via the through hole, and the pressing force with which the first relative movement unit presses the first mold is set smaller than the pressing force with which the second relative movement unit presses the third mold, whereby the workpiece material retained in the groove of the third mold is moved to the groove of the first mold via the through hole.

In this embodiment, since the workpiece material can be plastically deformed generally uniformly, variations of the grain size of the workpiece material can be suppressed.

According to the present invention, there is provided a plastic working method for workpiece material, comprising:

a workpiece material retaining step for retaining a workpiece material in part of a groove of a first mold, the groove being for retaining the workpiece material and being formed at least partly into a generally linear shape;

a first fitting step for fitting a first guide portion of a second mold to a place of the groove where the workpiece material is not placed, the second mold having the first guide portion to be relatively movably fitted to the groove, and further having a body portion having a through hole intersecting and communicating with the groove with the first guide portion fitted to the groove; and a workpiece material push-in step for making the first mold moved relative to the second mold with the first guide portion fitted to the groove so that the workpiece material substantially immovably retained in the groove of the first mold is bent by the first guide portion and pushed from the groove into the through hole.

According to the present invention, since the workpiece material substantially immovably retained in the groove of the first mold is bent by the first guide portion and guided from the groove into the through hole by moving the first mold relative to the second mold, the workpiece material is scarcely moved relative to the first mold, so that the first mold can be substantially completely prevented from occurrence of damage due to the movement relative to the workpiece material.

Also, according to the invention, since parts on which large force acts can be restricted roughly to proximities to the first guide portion of the second mold as well as to the through hole, the relatively moving part of the workpiece material can be reduced by an extent corresponding to the size of the groove so as to be restricted roughly only to the part of the through hole. Thus, occurrence of damage of the first and second molds in the device of the invention can be suppressed to a large extent, as compared with conventional molds in which the whole passage moves relative to the workpiece material, and the lives of the first and second molds can be greatly prolonged as compared with those of conventional molds.

Also, in one embodiment, the second mold has a second guide portion, the method further comprising:

a second fitting step for fitting the second guide portion of the second mold to a groove of a third mold, the third mold having the groove to which the second guide portion is to be fitted and which is to communicate with the through hole with the second guide portion fitted to the groove and moreover which is formed at least partly into a generally linear shape; and a retaining step for retaining a state that the first guide portion is fitted to the groove of the first mold while the second guide portion is fitted to the groove of the third mold, wherein in the workpiece material push-in step, at least part of the workpiece material is pushed into the groove of the third mold via the through hole.

In this embodiment, the state that the first guide portion is fitted to the groove of the first mold while the second guide portion is fitted to the groove of the third mold can reliably be retained. Also, the workpiece material can be bent twice because the workpiece material retained in the groove of the first mold is pushed into the groove of the third mold, and then the workpiece material is pushed into the groove of the third mold.

According to the composite mold of the present invention, a very large shearing force can be given to the workpiece material in the bending process at around the first guide portion, so that the crystal grain size of the workpiece material can be micro-fined. Therefore, material characteristics (strength, durability and the like of the material) after the working of the workpiece material can be greatly improved.

Also, according to the composite mold of the invention, since the workpiece material is scarcely moved relative to the first mold, the first mold can be substantially completely prevented from occurrence of damage due to the movement relative to the workpiece material.

Also, according to the composite mold of the invention, since the workpiece material substantially immovably retained in the groove of the first mold is bent by the first guide portion and pushed from the groove into the through hole by relative movement of the first mold to the second mold, the relatively moving part of the workpiece material can be reduced by an extent corresponding to the size of the groove so as to be restricted roughly only to the part of the through hole, and moreover parts on which large force acts can be restricted roughly to proximities to the first guide portion of the second mold as well as to the through hole. Accordingly, occurrence of damage of the composite mold in the invention can be suppressed to a large extent, as compared with conventional molds in which the whole passage moves relative to the workpiece material, and the life of the composite mold can be greatly prolonged as compared with those of conventional molds.

Also, according to the composite mold of the invention, most part of the relative movement force of the first mold and the second mold can be utilized as part of the force for reducing the grain size of the workpiece material. That is, according to the invention, the frictional force between the wall surface of the groove and the side faces of the workpiece material can be reduced to a large extent, unlike conventional molds in which frictional force between the wall surface of the groove and the side faces of the workpiece material makes the culprit of various problems. Therefore, the pressurizing force to be applied to the workpiece material can be reduced to a large extent, as compared with conventional molds which require pressurizing forces that overcome the frictional force between the workpiece material and the mold wall surface due to the force for pushing the workpiece material against the mold wall surface. Further, the force for reducing the grain size of the workpiece material can be greatly reduced from several hundreds of tons to several tons or less. Consequently, the sliding resistance in the through hole is so small that the life of the mold can be prolonged, and moreover the cost for plastic deformation of the workpiece material can be greatly reduced.

Further, according to the plastic working device for workpiece material in the invention, the first mold can be moved relative to the second mold by the first relative movement unit, and the workpiece material substantially immovably retained in the groove of the first mold can be bent by the first guide portion and pushed from the groove into the through hole. Therefore, a very large shearing force can be given to the workpiece material at around the first guide portion, so that the crystal grain size of the workpiece material can be micro-fined. Thus, material characteristics (strength, durability and the like of the material) after the working of the workpiece material can be greatly improved.

Also, according to the plastic working device for workpiece material in the invention, since the workpiece material is scarcely moved relative to the first mold, the first mold can be substantially completely prevented from occurrence of damage due to the movement relative to the workpiece material.

Also, according to the plastic working device for workpiece material in the invention, since the relatively moving part of the workpiece material can be reduced by an extent corresponding to the size of the groove so as to be restricted roughly only to the part of the through hole, and moreover parts on which large force acts can be restricted roughly to proximities to the first guide portion of the second mold as well as to the through hole. Accordingly, occurrence of damage of the first and second molds can be suppressed to a large extent, as compared with conventional molds in which the whole passage moves relative to the workpiece material, and the lives of the first and second molds can be greatly prolonged as compared with those of conventional molds.

Also, according to the plastic working method for workpiece material in the invention, since the workpiece material substantially immovably retained in the groove of the first mold is bent by the first guide portion and pushed from the groove into the through hole by moving the first mold relative to the second mold, the workpiece material is scarcely moved relative to the first mold, so that the first mold can be substantially completely prevented from occurrence of damage due to the movement relative to the workpiece material.

Also, according to the plastic working method for workpiece material in the invention, since parts on which large force acts can be restricted roughly to proximities to the first guide portion of the second mold as well as to the through hole, relatively moving part of the workpiece material can be reduced by an extent corresponding to the size of the groove so as to be restricted roughly only to the part of the through hole. Accordingly, occurrence of damage of the first and second molds can be suppressed to a large extent, as compared with conventional molds in which the whole passage moves relative to the workpiece material, and the lives of the first and second molds can be greatly prolonged as compared with those of conventional molds.

DETAILED DESCRIPTION OF THE INVENTION

Hereinbelow, the present invention will be described in detail by embodiments thereof illustrated in the accompanying drawings.

Figure 1A:
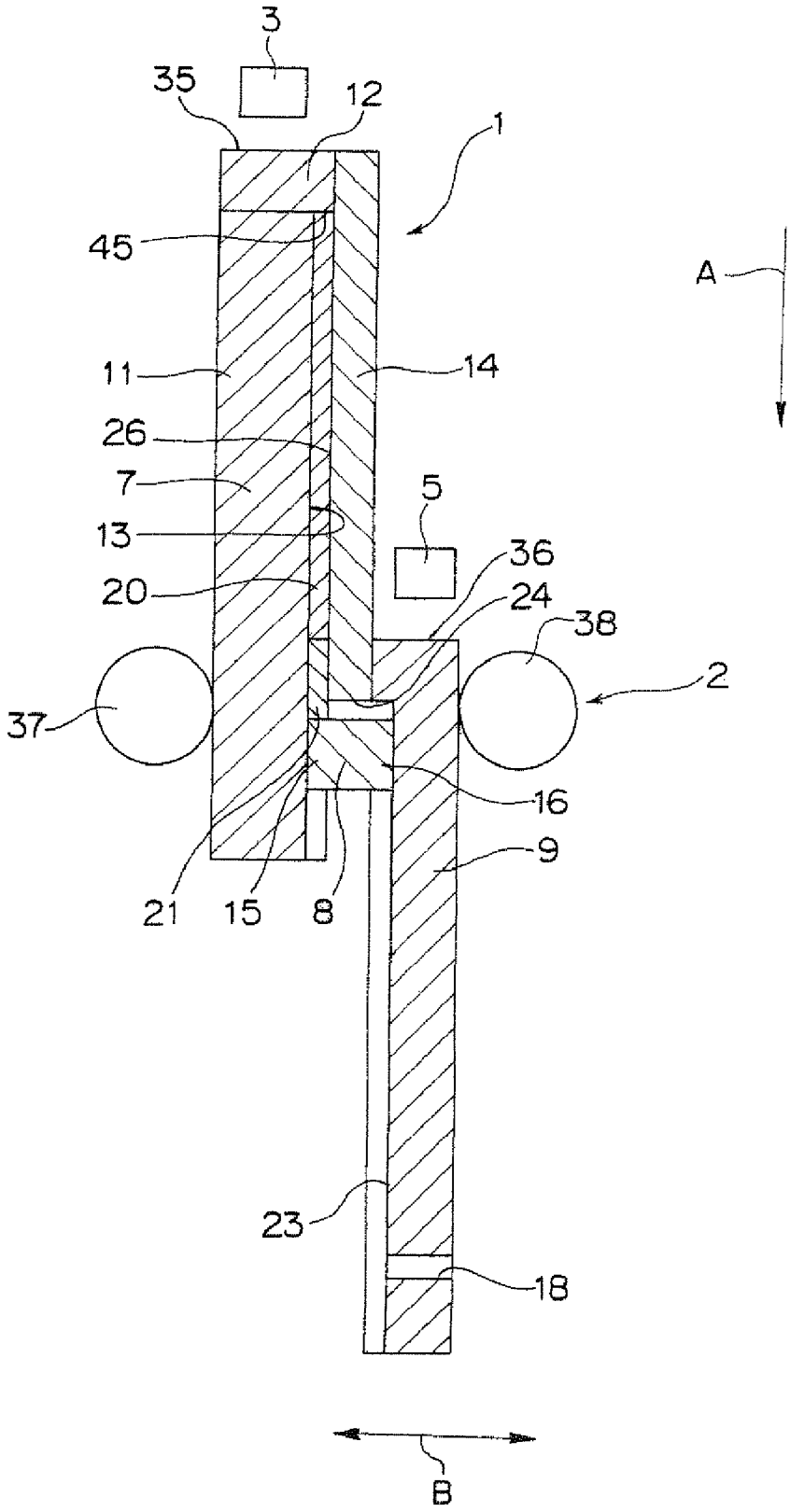
FIG. 1A is a sectional view of a plastic working device according to a first embodiment of the present invention.

FIG. 1A is a sectional view of a plastic working device for workpiece material according to a first embodiment of the invention (hereinafter, referred to as plastic working device). In FIG. 1A, reference numeral 20 denotes a titanium material made of pure titanium, which is an example of the workpiece material, and 21 denotes a dummy material serving for easier extrusion of the titanium material 20.

As shown in FIG. 1A, the plastic working device includes a composite mold 1 of the first embodiment of the invention, a retainer unit 2, a preloading press 3 as an example of a first relative movement unit, and a preloading press 5 as an example of a second relative movement unit. The composite mold 1 has a first mold 7, a second mold 8 and a third mold 9. The first mold 7, the second mold 8 and the third mold 9 are made of a mold metal.

The first mold 7 has a body portion 11 and an end portion 12. The body portion 11 has a generally rectangular parallelepiped shape. At a roughly widthwise center in one side face of the body portion 11, a generally linear-shaped groove 13 is formed so as to extend generally longitudinally from one longitudinal end to the other longitudinal end of the body portion. The groove 13 is to accommodate therein the generally linear-shaped titanium material 20. In other words, the groove 13 is to retain the titanium material 20. The end portion 12 adjoins the body portion 11 in an extending direction of the groove 13 and covers one end of the groove 13.

The end portion 12, which is fittable to and removable from the body portion 11, is attached to the body portion 11 during operation of the plastic working device, and removed from the body portion 11 for the extraction of a completed-product workpiece material that has been subjected to a desired plastic working. The end portion 12 retains the titanium material 20 substantially immovably within the groove 13 by an end face 45 of the end portion 12 confronting the groove 13.

Figure 1B:
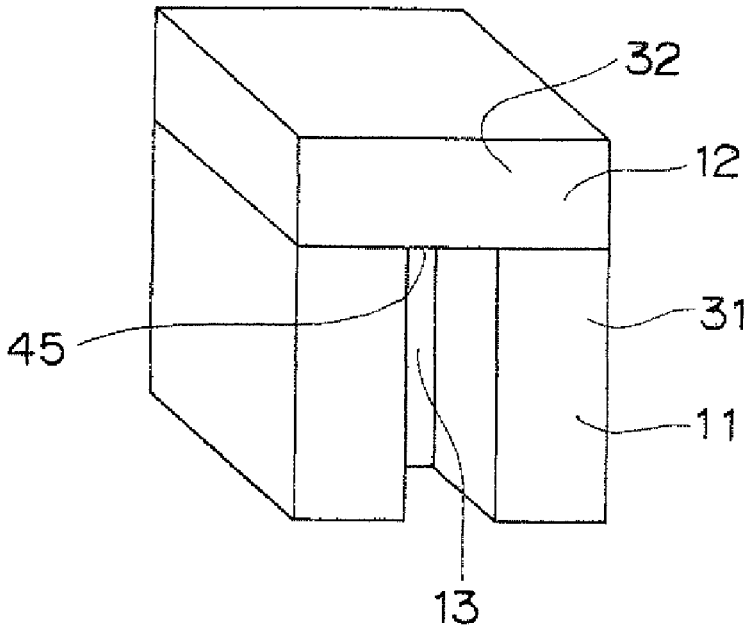
FIG. 1B is a perspective view showing a connecting portion between body portion and end portion of a first mold.

FIG. 1B is a perspective view showing a vicinity of a connecting portion at which the end portion 12 is connected to the body portion 11. As shown in FIG. 1B, a cross section of the groove 13 perpendicular to a direction in which the groove 13 extends has a generally rectangular cross-sectional shape. In the state that the end portion 12 is connected to the body portion 11, an end face 31 of the body portion 11 in which the groove 13 is formed, and one end face 32 of the end portion 12, are generally flush with each other. The connection between the body portion 11 and the end portion 12 is fulfilled, for example, in a way that three protrusions which are formed at three points in the end face of the body portion in the extending direction so as to protrude in the extending direction from the end face are fitted, respectively, to three recesses which are formed at three points in the end face 45 of the end portion 12 so as to be shaped in correspondence to the protrusions.

Reverting to FIG. 1A, the third mold 9, which differs from the first mold 7 only in that a body portion and an end portion are integrally formed, and that a through hole 18 for extraction of the dummy member 21 is provided, is similar to the first mold 7 in all the other properties such as configuration. In FIG. 1A, reference numeral 23 denotes a groove of the third mold 9. The groove 23 of the third mold 9 communicates with the through hole 18.

As shown in FIG. 1A, the second mold 8 has a generally rectangular parallelepiped-shaped body portion 14, a first guide portion 15, and a second guide portion 16. The first guide portion 15 is a protruding portion that protrudes from a first side face of the body portion 14, and the second guide portion 16 is a protruding portion that protrudes from a second side face of the body portion 14 generally parallel to the first side face.

A through hole 24 is formed in the body portion 14. This through hole 24 extends generally linearly in the widthwise direction of one side face of the body portion 14. The through hole 24 has a generally rectangular cross-sectional shape. This cross-sectional shape generally corresponds to cross-sectional shapes of cross sections of the grooves 13, 23 in a direction perpendicular to the extending directions of the grooves 13, 23.

The first guide portion 15 is to be relatively movably fitted to the groove 13 of the first mold 7, while the second guide portion 16 is to be relatively movably fitted to the groove 23 of the third mold 9. In the state that the first guide portion 15 is fitted to the groove 13 while the second guide portion 16 is fitted to the groove 23, one end of the through hole 24 communicates with the groove 13 while the other end of the through hole 24 communicates with the groove 23. In this fitting state, the extending direction of the groove 13 generally perpendicularly intersects the extending direction of the through hole 24, while the extending direction of the through hole 24 generally perpendicularly intersects the extending direction of the groove 23.

Also, in the fitting state, the groove 13 of the first mold 7, one face of the second mold 8 on its one side closer to the groove 13, and the first guide portion 15 form a closed space that closes widthwise ends and at least longitudinal one end of the titanium material 20. Also in the fitting state, a portion of the groove 13 in which the titanium material 20 is accommodated is completely blocked by the body portion 14 of the second mold 8. That is, in the fitting state, an external surface of the body portion 14 adjoining part of the opening of the through hole 24 has a surface portion (a face of the second mold 8 on its groove 13 side) 26 that makes close contact with the face of the first mold 7 in which the groove 13 is formed. Then, the body portion 14 has a length in the extending direction of the groove 13 which is not more than a total sum of a length of a portion of the surface portion 26 covering the groove 13 in the extending direction of the groove 13, a length of the through hole 24 in the extending direction, and a length of the first guide portion 15 in the extending direction.

Figure 1C:
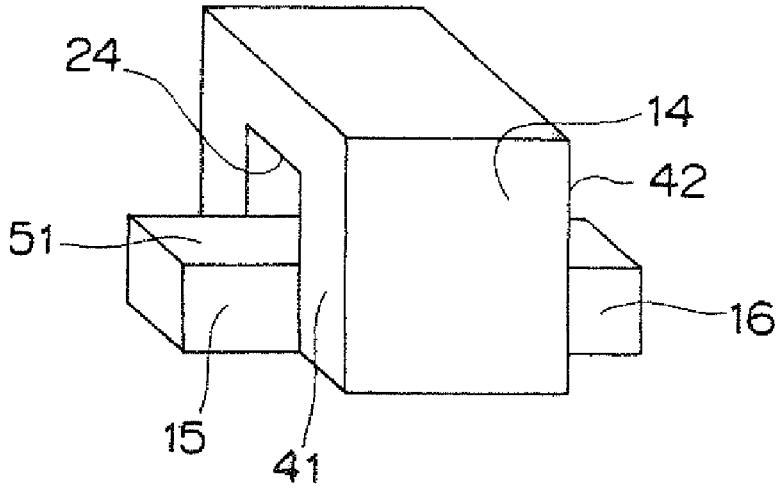
FIG. 1C is a perspective view showing a portion of a second mold around its through hole.

FIG. 1C is a perspective view showing a portion of the second mold 8 in the vicinity of the through hole 24. The first guide portion 15 and the second guide portion 16 are generally rectangular parallelepiped shaped. Four planar-shaped side faces of the through hole 24 are each generally parallel to two out of six planar-shaped outer faces of the generally rectangular parallelepiped-shaped body portion 14. The first guide portion 15 extends from one side face 41 of the body portion 14 along a normal line of the side face 41, while the second guide portion 16 extends from a side face 42 generally parallel to the side face 41 of the body portion 14 along a normal line of the side face 42. The body portion 14 is so shaped as to be generally plane symmetrical with respect to a perpendicular bisector plane that stretches along a direction perpendicular to the extending direction of the through hole 24 to perpendicularly bisect the through hole 24. One of the four side faces of the through hole 24, and a side face portion (a face of the first guide portion 15 confronting the closed space) 51 of the first guide portion 15 over which the workpiece material is to be bent, are contiguous to and generally flush with each other. An end face of the body portion 14 which is closer to the first guide portion 15 than the through hole 24 and which extends along a direction perpendicular to the extending direction of the through hole 24 is fixed to an unshown anchor block. As a result of this, the second mold 8 is immobilized.

Figure 1D:
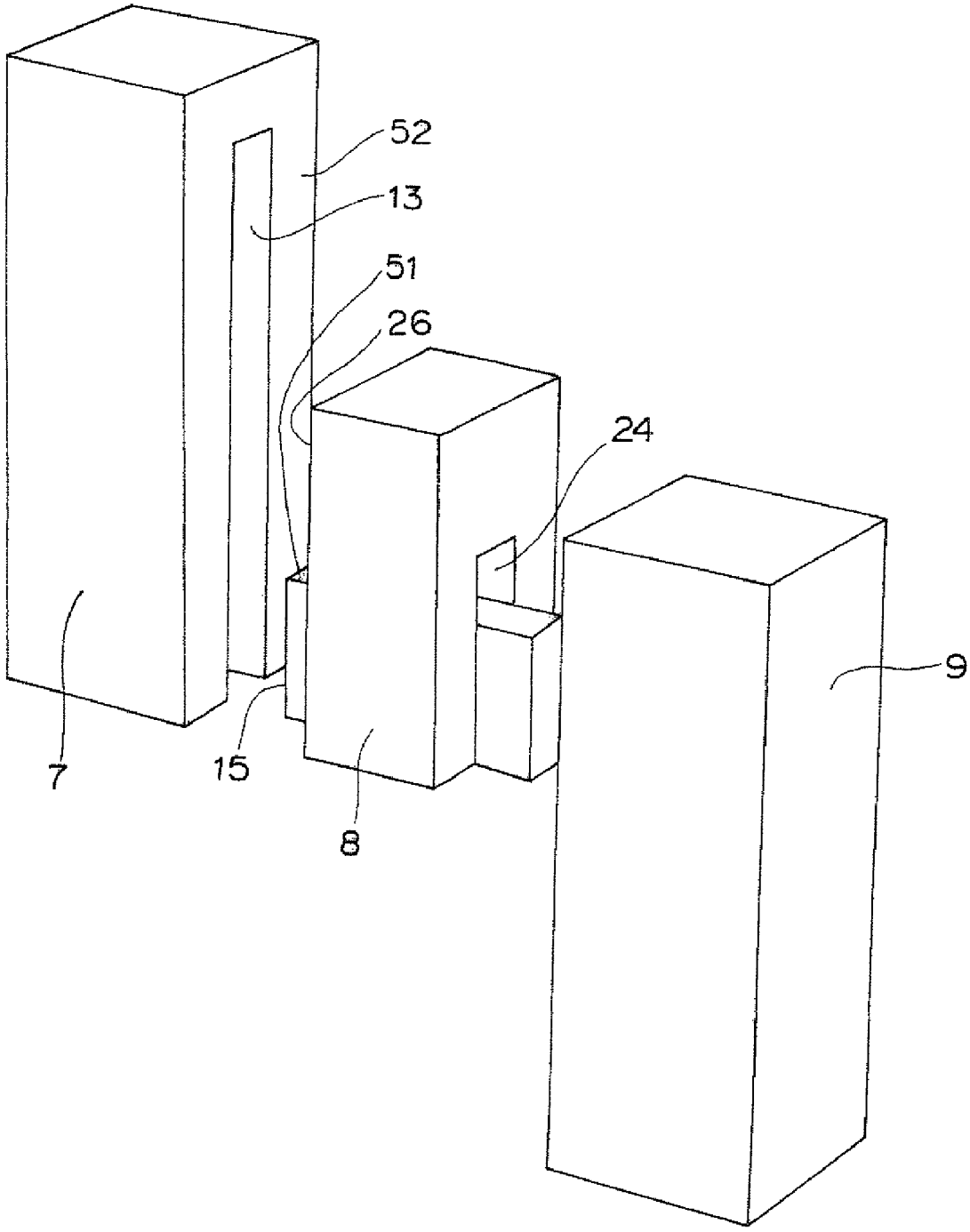
FIG. 1D is a perspective view showing part of a composite mold according to the first embodiment of the invention.
Figure 1E:
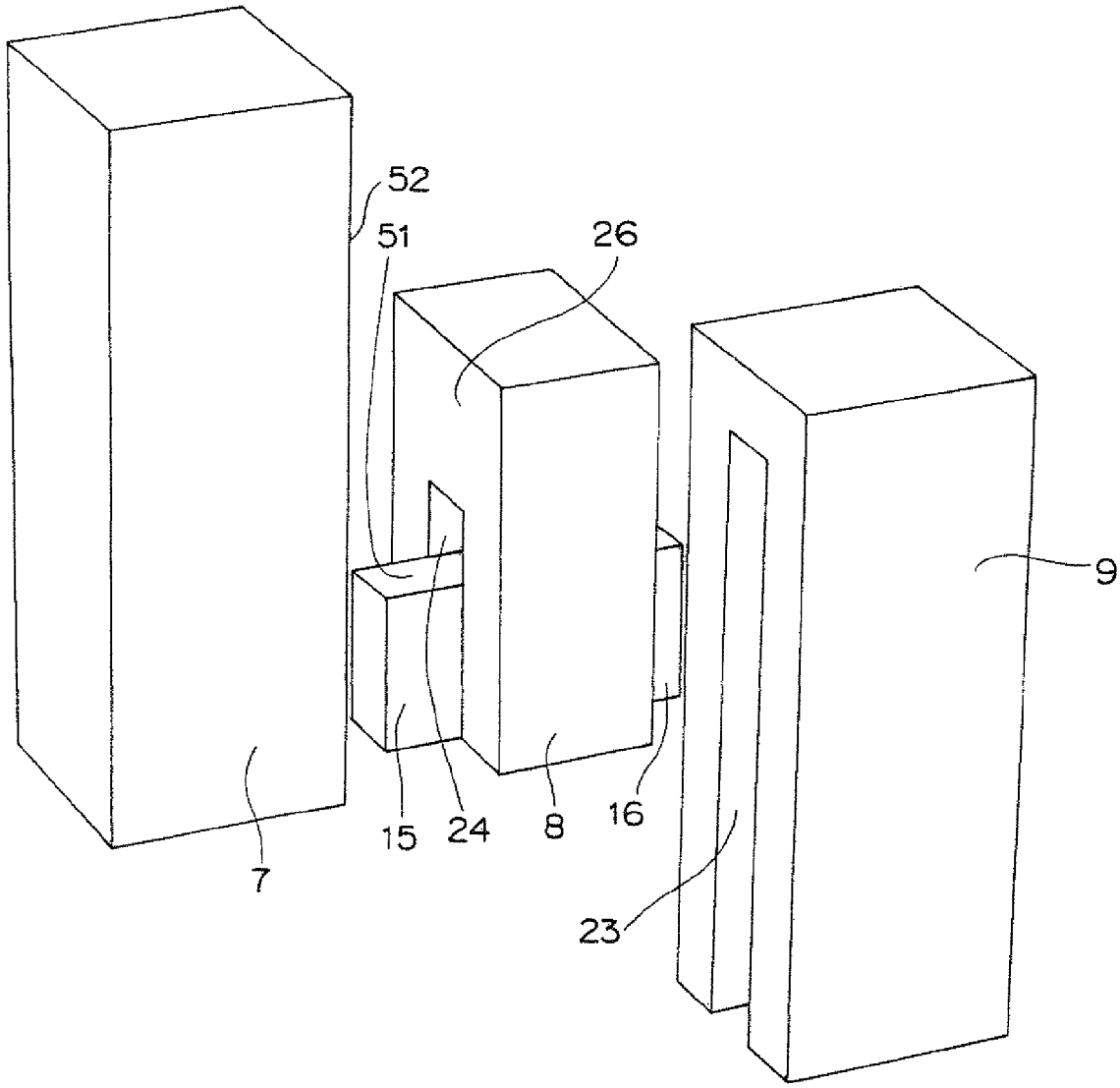
FIG. 1E is a perspective view showing part of the composite mold according to the first embodiment of the invention.

FIG. 1D is a perspective view showing part of the composite mold 1 in a state that the first mold 7 and the second mold 8 are not fitted to each other and moreover the second mold 8 and the third mold 9 are not fitted to each other. Also, FIG. 1E is a perspective view resulting when the part of the composite mold 1 is viewed along a different direction. In FIGS. 1D and 1E, lines showing that an end portion of the first mold 7 is a removable type one are omitted for simplicity's sake.

As shown in FIGS. 1D and 1E, a cross-sectional shape of the groove 13 of the first mold 7 taken along a direction perpendicular to the extending direction of the groove 13, and a cross-sectional shape of the first guide portion 15 taken in a cross section parallel to the side face portion 51 over which the workpiece material is to be bent in the first guide portion 15, are generally coincident with each other. As a result of this, with the first guide portion 15 fitted to the groove 13, an end face 52 of the first mold 7 having the groove 13 and the surface portion 26 from which the first guide portion 15 protrudes are put into close contact with each other. Also, the side face portion 51 is an extension surface of one of the four planar-shaped side faces of the through hole 24, and the side face portion 51 and the one of the side faces are positioned so as to be generally flush with each other.

Reverting again to FIG. 1A, the retainer unit 2 has a first backup roller 37, a second backup roller 38, a first electric cylinder (not shown) for pressing the first backup roller 37 in one direction, and a second electric cylinder (not shown) for pressing the second backup roller 38 in one direction. The retainer unit 2 actuates the first electric cylinder to press the first backup roller 37 against a side face of the first mold 7 opposed to the side face in which the groove 13 is formed, and moreover actuates the second electric cylinder to press the second backup roller 38 against a side face of the third mold 9 opposed to the side face on which the groove 23 is formed. In this way, pressing force indicated by arrow B in FIG. 1A is applied to the first to third molds 7, 8, 9 by the first backup roller 37 and the second backup roller 38, thereby retaining a fitting state that the first guide portion 15 is fitted to the groove 13 of the first mold 7 while the second guide portion 16 is fitted to the groove 23 of the third mold 9.

The preloading press 3 (which may be, for example, one of those used for pressure molding of concrete products) is enabled to apply very high pressures of up to several hundreds of tons or so, and moreover the preloading press 3 is enabled to freely vary the pressing force. The preloading press 3 presses an end face 35 of the end portion 12 of the first mold 7 toward the first guide portion 15, i.e., toward a direction indicated by arrow A in FIG. 1A. Also, the preloading press 5 is similar to the preloading press 3. The preloading press 5 presses an end face of the third mold 9, which is placed on the same side of the through hole 24 as the end portion 12 and which is one end in the extending direction of the groove 23, toward the second guide portion 16, i.e., along the direction indicated by arrow A.

FIGS. 2A to 2G are views for explaining an embodiment of the plastic working method for workpiece materials (hereinafter, referred to as plastic working method) according to the invention. The plastic working method of this embodiment is to perform plastic working of workpiece material by using the above-described plastic working device. Next, the plastic working device of this embodiment is explained with reference to FIGS. 2A to 2F. For simplicity's sake, the preloading press 3 and the preloading press 5 are omitted in FIGS. 2A to 2G, and the retainer unit 2 is omitted in FIGS. 2B to 2G.

First, a workpiece material retaining step is performed. In this workpiece material retaining step, the titanium material 20 made of a pure titanium material as an example of the workpiece material as well as the dummy material 21 to be put into contact with the titanium material 20 are accommodated in part of the generally linear-shaped groove 13 of the first mold indicated by 7 in FIG. 2A.

Next, a first fitting step and a second fitting step are carried out. In these steps, the first guide portion 15 is fitted to a place in the groove 13 of the first mold 7 where neither the titanium material 20 nor the dummy material 21 is placed, and moreover the second guide portion 16 is fitted to the groove 23 of the third mold 9. As to these steps, the first fitting step and the second fitting step may be carried out simultaneously, or the first fitting step may be carried out before the second fitting step is done, or the second fitting step may be carried out before the first fitting step is done.

Subsequently, a retaining step is performed. In this retaining step, in the state that the first guide portion 15 is fitted to the groove 13 of the first mold 7 while the second guide portion 16 is fitted to the groove 23 of the third mold 9, the first and second electric cylinders are actuated so that the fitted first to third molds 7, 8, 9 are sandwiched between the first backup roller 37 and the second backup roller 38. In this way, by the first backup roller 37 and the second backup roller 38, pressing force indicated by the arrow B is made to act on the first to third molds 7, 8, 9, by which the fitting state is retained.

Figure 2C:
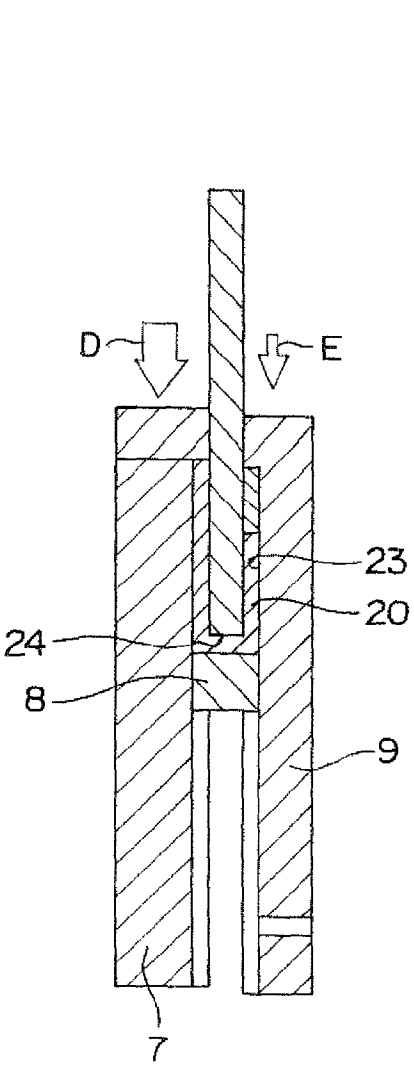
FIG. 2C is a view for explaining an embodiment of a plastic working method according to the invention.
Figure 2B:
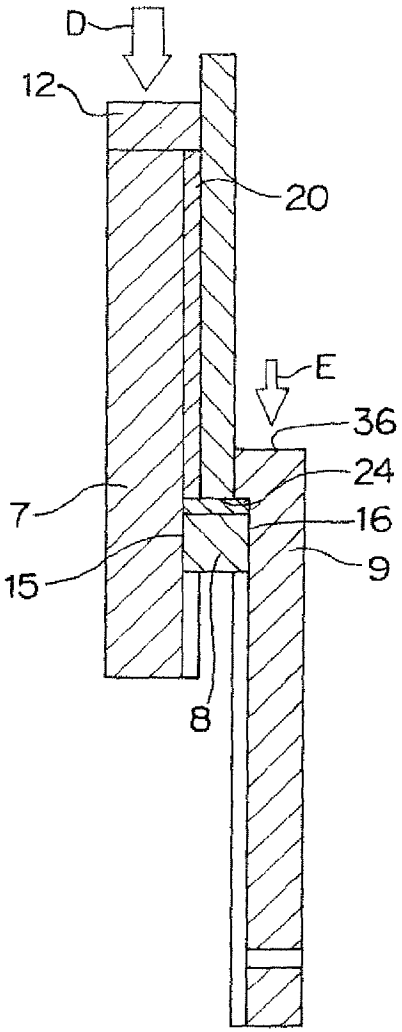
FIG. 2B is a view for explaining an embodiment of a plastic working method according to the invention.
Figure 2A:
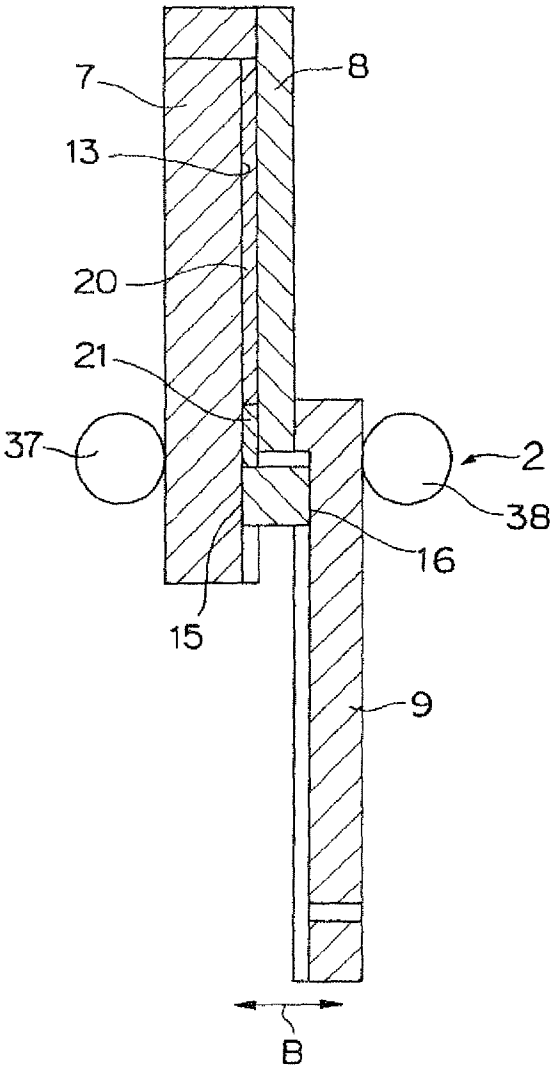
FIG. 2A is a view for explaining an embodiment of a plastic working method according to the invention.
Figure 2F:
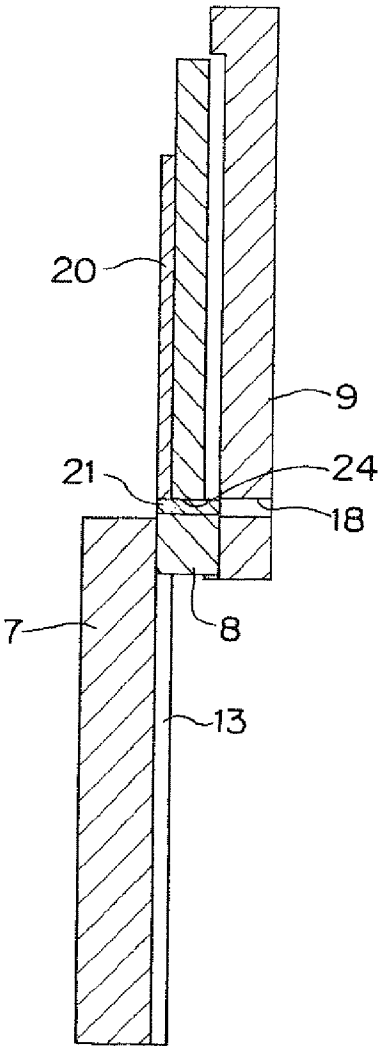
FIG. 2F is a view for explaining an embodiment of a plastic working method according to the invention.

Next, a workpiece material push-in step is performed. In this workpiece material push-in step, the end portion 12 of the first mold 7 is pressed by the preloading press 3 in a direction indicated by arrow D in FIG. 2B, and moreover an end face 36 of the third mold 9 is pressed by the preloading press 5. In this operation, with the pressing force by the preloading press 3 set larger than the pressing force by the preloading press 5, the first mold 7 is moved relative to the second mold 8 fixed and immobilized to the unshown anchor block so as to make the end portion 12 approach the first guide portion 15, by which the dummy material 21 and the titanium material 20 are pressed from the groove 13 of the first mold 7 via the through hole 24 into the groove 23 of the third mold 9 as shown in FIGS. 2B and 2C. In other words, by relative movement of the first mold 7 to the second mold 8, the titanium material 20 substantially immovably retained in the groove 13 of the first mold 7 is bent by the first guide portion 15 so as to be pushed from the groove 13 into the through hole 24, and further the titanium material 20 pushed into the through hole 24 is bent by a bottom face of the groove 23 of the third mold 9 so as to be pushed into the groove 23 through the through hole 24.

Figure 2E:
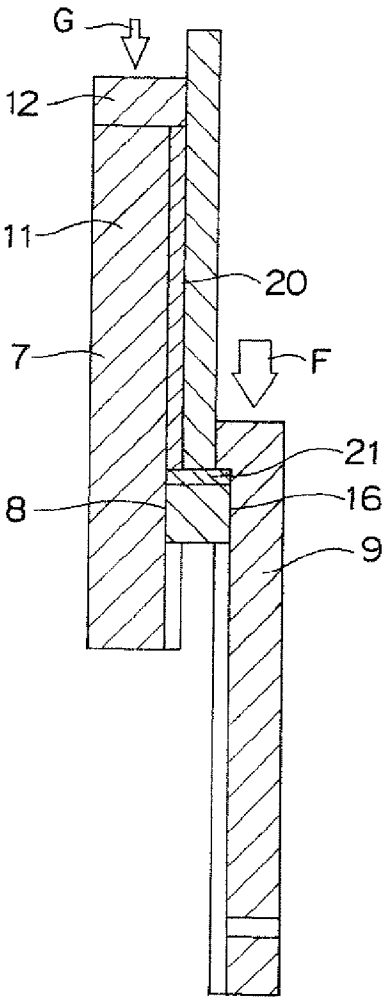
FIG. 2E is a view for explaining an embodiment of a plastic working method according to the invention.
Figure 2D:
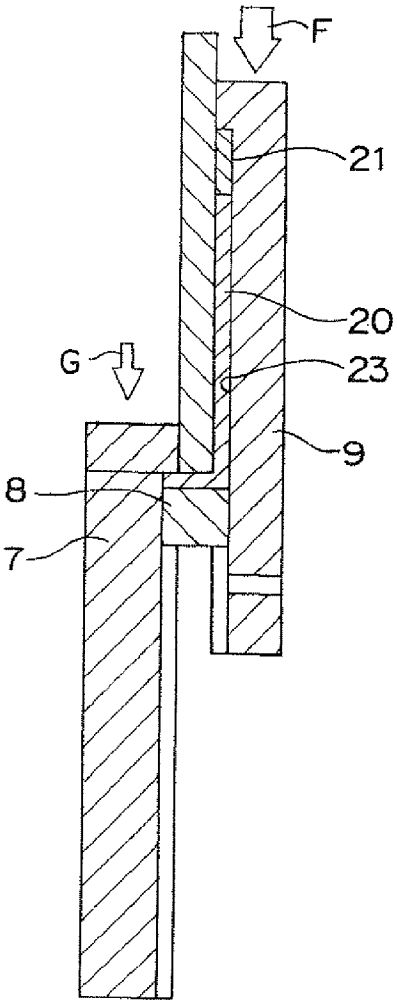
FIG. 2D is a view for explaining an embodiment of a plastic working method according to the invention.

In this way, as shown in FIG. 2D, the dummy material 21 and the titanium material 20 are pushed from the groove 13 of the first mold 7 through the through hole 24 into the groove 23 of the third mold 9 until a length of a part of the titanium material 20 accommodated in the groove 13 in the extending direction of the groove 13 becomes generally coincident with a length of the through hole 24 in the extending direction of the groove 13. In the state shown in FIG. 2D, most part of the titanium material 20 adjoining the dummy material is subjected twice to severe bending plastic deformation, and the part of the titanium material 20 generally corresponding to the length of the through hole 24 is subjected once to severe bending plastic deformation.

Subsequently, converse to the foregoing, a pressing force by the preloading press 5 indicated by arrow F in FIGS. 2D and 2E is set larger than a pressing force by the preloading press 3 indicated by arrow G in FIGS. 2D and 2E, and the third mold 9 is moved relative to the second mold 8 so as to make the end face 36 of the third mold 9 approach the second guide portion 16, by which the titanium material 20 and the dummy material 21 are pressed from the groove 23 of the third mold 9 via the through hole 24 into the groove 13 of the first mold 7. Then, as shown in FIG. 2E, the titanium material 20 and the dummy material 21 accommodated in the groove 23 are pushed into the through hole 24 and the groove 13 of the first mold 7 until a length of a part of the dummy material 21 accommodated in the groove 23 in the extending direction of the groove 23 becomes generally coincident with a length of the through hole 24 in the extending direction of the groove 23.

Figure 2G:
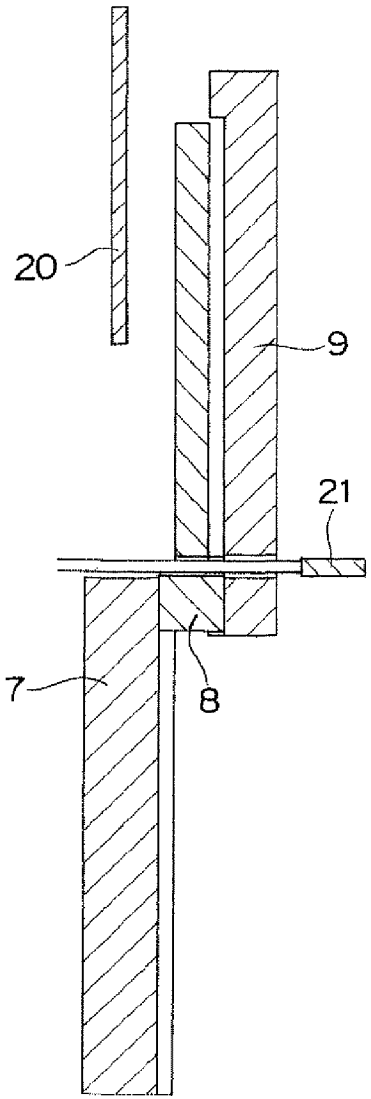
FIG. 2G is a view for explaining an embodiment of a plastic working method according to the invention.

Subsequently, a product extraction step is performed. In this product extraction step, pressing forces of the first and second backup rollers 37, 38 are released, the end portion 12 is removed from the body portion 11, and further the first mold 7 is moved relative to the second mold 8 so that the entirety of the titanium material 20 is positioned outside the groove 13. Simultaneously with the relative movement, the third mold 9 is moved relative to the second mold 8 so that the through hole 24 of the second mold 8 and the through hole 18 for extraction of the dummy material 21 of the third mold 9 are positioned generally on one straight line. Thereafter, as shown in FIG. 2G, the titanium material 20, which has been subjected to plastic deformation so as to be remarkably downsized in grain size as a completed product, is extracted and moreover the dummy material 21 is extracted via the through hole 24 and the through hole 18. The extracted dummy material 21 may be reused for plastic deformation of new titanium material.

According to the composite mold 1 of this first embodiment, since the first guide portion 15 acts so that the titanium material 20 substantially immovably retained in the groove 13 of the first mold 7 is bent and pushed from the groove 13 into the through hole 24 by relative movement of the first mold 7 to the second mold 8, a severely large shearing force can be given to the titanium material 20 in the bending process at the bending portion around the first guide portion 15, so that the crystal grain size of the titanium material 20 can be micro-fined. Therefore, material characteristics of the titanium material 20 (strength, durability and the like of the material) after its working can be greatly improved.

Also, according to the composite mold 1 of the first embodiment, since the titanium material 20 substantially immovably retained in the groove 13 of the first mold 7 is bent by the first guide portion 15 and pushed from the groove 13 into the through hole 24 by relative movement of the first mold 7 to the second mold 8, the part along which the titanium material 20 moves relative to the first mold 7, as compared with conventional molds, can be reduced by an extent corresponding to the size of the groove 13 so as to be restricted roughly only to the part of the through hole 24, and moreover parts on which large force acts can be restricted roughly to proximities to the first guide portion 15 of the second mold 8 as well as to the through hole 24. Accordingly, occurrence of damage of the composite mold 1 can be suppressed to a large extent, as compared with conventional molds in which the whole passage moves relative to the workpiece material, and the life of the mold to be used for plastic deformation of material to make its grain size quite small can be greatly prolonged as compared with conventional counterparts.

Further, according to the composite mold 1 of the first embodiment, most part of the relative movement force of the first mold 7 and the second mold 8 can be utilized as part of the force for reducing the grain size of the workpiece material. That is, according to the invention, the frictional force between the wall surface of the groove 13 and the side faces of the workpiece material can be reduced to a large extent, unlike conventional molds in which frictional force between a wall surface of a groove and side faces of workpiece material makes the culprit of various problems. Therefore, the pressurizing force to be applied to the workpiece material can be reduced to a large extent, as compared with conventional molds which require pressurizing forces that overcome the frictional force between the workpiece material and the mold wall surface due to the force for pushing the workpiece material against the mold wall surface. As a result of this, the pressurizing force (pressing force) applied to the workpiece material (titanium material 20 in this embodiment) can be abruptly reduced from conventional several hundreds of tons to several tons or less. Consequently, in addition to the damage prevention of the second mold 8, the cost for plastic deformation of the workpiece material can be reduced to a large extent.

Also, according to the composite mold 1 of the first embodiment, the body portion 14 of the second mold 8 adjoins part of the opening of the through hole 24, and moreover the composite mold 1 includes the surface portion 26 that makes close contact with the end face 52 and that confronts the groove 13 of the first mold 7. Therefore, the titanium material 20 bent by the first guide portion 15 can be led toward the through hole 24 with reliability.

Also, according to the composite mold 1 of the first embodiment, since the side face portion 51 of the first guide portion 15 for bending the titanium material 20 is an extension surface of part of the side face of the through hole 24, the titanium material 20 bent (reduced in grain size) by the first guide portion 15 can be pushed into the through hole 24 smoothly.

Also, according to the composite mold 1 of the first embodiment, since the through hole 24 of the second mold 8 extends generally linearly and since the extending direction of the groove 13 of the first mold 7 generally perpendicularly intersects the extending direction of the through hole 24, plastic deformation of an about 90-degree angle can be applied to the titanium material 20, so that the titanium material 20 can be subjected to the most severe shear plastic deformation. Therefore, the grain size of the titanium material 20 can be reduced to about one thousandth, so that the titanium material 20 can be greatly improved about twice higher in strength and about 100 times higher in durability.

Also, according to the composite mold 1 of the first embodiment, the titanium material 20 retained in the groove 13 of the first mold 7 can be pushed into the groove 23 of the third mold 9 via the through hole 24. In addition, the titanium material 20 pushed into the groove 23 of the third mold 9 can once again be pushed into the first mold 7 via the through hole 24, so that the cost for achieving desired material characteristics of the after-working titanium material 20 can be reduced to a large extent.

Also, according to the composite mold 1 of the first embodiment, since part of the side faces of the second guide portion 16 is an extension surface of part of the side faces of the through hole 24, the titanium material 20 that has passed through the through hole 24 can be smoothly pushed into the groove 23 of the third mold 9 along the side face of the second guide portion 16.

Also, according to the composite mold 1 of the first embodiment, the through hole 24 has a generally rectangular cross-sectional shape, and the side face portion 51 of the first guide portion 15 for bending the titanium material 20, part of the side faces of the through hole 24 and part of the second guide portion 16 are generally flush with one another. Therefore, the titanium material 20 retained in the groove 13 of the first mold 7 can be easily pushed into the groove 23 of the third mold 9 via the through hole 24, and conversely, the titanium material 20 retained in the groove 23 of the third mold 9 can be easily pushed into the groove 13 of the first mold 7 via the through hole 24.

Also, according to the composite mold 1 of the first embodiment, the first guide portion 15 has a simple, generally rectangular parallelepiped shape, and a cross section of the groove 13 of the first mold 7 perpendicular to the extending direction of the groove 13 has a simple, generally rectangular shape. Therefore, the first guide portion 15 and the groove 13 of the first mold 7 can be manufactured with simplicity and low cost.

Also, according to the composite mold 1 of the first embodiment, the first mold 7 has the body portion 11 with the groove 13 formed therein, and the end portion 12 which adjoins the body portion 11 in the extending direction of the groove 13 and which covers one end of the groove 13, so that the titanium material 20 is substantially immovably retained in the groove 13 of the first mold 7 by the end face 45 of the end portion 12 confronting the groove 13. Therefore, the titanium material 20 can be pressed by the end face 45 and, as a result of this, the titanium material 20 can be substantially immovably retained in the groove 13 of the first mold 7.

Also, according to the composite mold 1 of the first embodiment, since the end portion 12 is fittable to and removable from the body portion 11 of the first mold 7, removing the end portion 12 allows the titanium material 20, which is a completed product subjected to plastic deformation, to be easily extracted from the composite mold 1.

Also, according to the composite mold 1 of the first embodiment, the through hole 24 extends generally linearly, and a cross-sectional shape of the groove 13 of the first mold 7, a cross-sectional shape of the through hole 24 and a cross-sectional shape of the groove 23 of the third mold 9 are generally identical to one another. Thus, the frictional force between the through hole 24 and the titanium material 20 can be reduced, so that the life of the composite mold 1 can be further prolonged.

Also, according to the composite mold 1 of the first embodiment, since the three molds 7, 8, 9 are included and since the extending direction of the groove 13 of the first mold 7 and the extending direction of the groove 23 of the third mold 9 generally perpendicularly intersect the extending direction of the through hole 24, shear plastic deformation of a 90-degree angle can be easily applied to the titanium material 20 a plurality of times, so that the titanium material 20 can be subjected to the most severe shear plastic deformation a plurality of times. Therefore, the grain size of the titanium material 20 can be abruptly reduced to about one thousandth, so that the titanium material 20 can be abruptly improved about twice higher in strength and about 100 times higher in durability.

Also, according to the plastic working device of this embodiment, the first mold 7 can be moved relative to the second mold 8 by the preloading press 3, which is a first relative movement unit, so that the titanium material 20 substantially immovably retained in the groove 13 of the first mold 7 is bent by the first guide portion 15 so as to be pushed from the groove 13 into the through hole 24. Therefore, a very large shearing force can be given to the titanium material 20 by the bending portion around the first guide portion 15 and, as a result, the crystal grain size of the titanium material 20 can be micro-fined. Thus, material characteristics of the titanium material 20 (strength, durability and the like of the material) after its working can be greatly improved.

Also, according to the plastic working device of this embodiment, since the titanium material 20 is scarcely moved relative to the first mold 7, the first mold 7 can be substantially completely prevented from occurrence of damage due to the movement relative to the titanium material 20.

Also, according to the plastic working device of this embodiment, the part along which the workpiece material slidingly moves relative to the passage, as compared with conventional molds, can be reduced by an extent corresponding to the size of the groove 13 so as to be restricted roughly only to the part of the through hole 24, and moreover parts on which large force acts can be restricted roughly to proximities to the first guide portion 15 of the second mold 8 as well as to the through hole 24. Accordingly, occurrence of damage of the first and second molds 7, 8 can be suppressed to a large extent, as compared with conventional molds in which the whole passage moves relative to the workpiece material, and the lives of the first and second molds 7, 8 can be greatly prolonged as compared with conventional molds.

Also, according to the plastic working device of this embodiment, since the retainer unit 2 as an example of the retainer unit retains the state that the first guide portion 15 is fitted to the groove 13 of the first mold 7 while the second guide portion 16 is fitted to the groove 23 of the third mold 9, the first guide portion 15 can reliably be prevented from being released out from the groove 13 of the first mold 7 during the operation of the plastic working device, and moreover the second guide portion 16 can reliably be prevented from being released out from the groove 23 of the third mold 9.

Also, according to the plastic working device of this embodiment, since the preloading press 5 for moving the second mold 8 and the third mold 9 relative to each other is included, the titanium material 20 pushed from the groove 13 of the first mold 7 via the through hole 24 into the groove 23 of the third mold 9 can once again be pushed into the groove 13 of the first mold 7 via the through hole 24.

Also, according to the plastic working device of this embodiment, the second mold 8 is fixed to the anchor block, and the preloading press 3 presses the first mold 7 so as to downsize the groove 13 part of the first mold 7 communicating with the through hole 24, while the preloading press 5 presses the third mold 9 so as to downsize the groove 23 part of the third mold 9 communicating with the through hole 24. Then, the pressing force of the preloading press 3 for pressing the first mold 7 is set larger than the pressing force of the preloading press 5 for pressing the third mold 9, by which the titanium material 20 retained in the groove 13 of the first mold 7 is moved to the groove 23 of the third mold 9 via the through hole 24. On the other hand, the pressing force of the preloading press 3 for pressing the first mold 7 is set smaller than the pressing force of the preloading press 5 for pressing the third mold 9, by which the titanium material 20 retained in the groove 23 of the third mold 9 is moved into the groove 13 of the first mold 7 via the through hole 24. Therefore, severe plastic deformation can be easily applied to the titanium material 20 a plurality of times and, as a result, the grain size of the titanium material can be subdivided generally uniformly so that the titanium material can be greatly improved in strength and durability.

Also, according to the plastic working method of this embodiment, the first mold 7 is moved relative to the second mold 8, by which the titanium material 20 substantially immovably retained in the groove 13 of the first mold 7 is bent by the first guide portion 15 so as to be pushed from the groove 13 into the through hole 24. Therefore, the titanium material 20 is scarcely moved relative to the first mold 7, by which the first mold 7 can be substantially completely prevented from being damaged due to the movement relative to the titanium material 20.

Also, according to the plastic working method of this embodiment, parts on which large force acts can be restricted roughly to proximities to the first guide portion 15 of the second mold 8 as well as to the through hole 24. Therefore, the part along which the titanium material 20 makes relative movement can be reduced roughly by the extent corresponding to the size of the groove 13 so as to be restricted roughly only to the part of the through hole 24. Thus, occurrence of damage of the mold can be suppressed to a large extent, as compared with conventional molds in which the whole passage moves relative to the workpiece material, and the lives of the first and second molds 7, 8 can be greatly prolonged as compared with conventional counterparts.

Also, according to the plastic working method of this embodiment, the state that the first guide portion 15 is fitted to the groove 13 of the first mold 7 while the second guide portion 16 is fitted to the groove 23 of the third mold 9 can reliably be retained. Further, the titanium material 20 retained in the groove 13 of the first mold 7 can be pushed into the groove 23 of the third mold 9, and most part of the titanium material 20 can be bent twice until the titanium material 20 is pushed into the groove 23 of the third mold 9.

Also, according to the composite mold 1 of the first embodiment, the length over which the groove 13 extends is set to not more than a length which is a total sum of a length of the largest portion of the groove 13 that can be covered with the surface portion 26 in the extending direction of the groove 13, a length of the through hole 24 in the extending direction of the groove 13 and a length of the first guide portion 15 in the extending direction of the groove 13, the portion of the groove 13 communicating with the through hole 24 can constantly be covered with the groove 13 side surface of the second mold 8 in the state that the first guide portion 15 is fitted to the groove 13. Therefore, the titanium material 20 can reliably be prevented from being released out from the groove 13.

In addition, in the composite mold 1 of the first embodiment, the portion of the groove 13 communicating with the through hole 24 is constantly covered with the groove 13 side surface of the second mold 8 in the state that the first guide portion 15 is fitted to the groove 13. However, in this invention, it is also allowable that only part of the groove 13 retaining the titanium material 20 is blocked by the surface portion 26 of the second mold 8 in the state that the first guide portion 15 is fitted to the groove 13. In this case, since the sliding area between the second mold 8 and the titanium material 20 can be reduced, the sliding resistance between the second mold 8 and the titanium material 20 can be reduced, so that the life of the second mold 8 can be further prolonged and moreover that pressurizing force necessary for micro-fining of the grain size of the workpiece material such as titanium material can be further reduced. In this case also, when an end corner of the surface portion 26 in the extending direction of the groove 13 on one side opposite to the side on which the through hole 24 is provided are machined for chamfering, a portion of the titanium material 20 that is not covered with the surface portion 26 at a start of plastic working can be smoothly pushed into the space covered with the groove 13 of the first mold 7 and the surface portion 26 at the start of the plastic working, preferably.

Figure 3A:
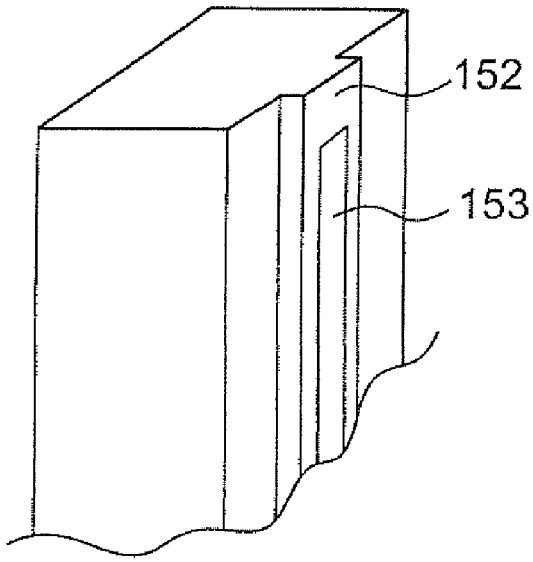
FIG. 3A is a perspective view showing part of a modification of the first mold.

Furthermore, the surface portion 52 of the first mold 7 and the surface portion 26 of the second mold 8 are to slide uniformly with an equal width in the figures of this embodiment. However, in one case where a portion of a surface portion 152 to surround a groove 153 is left with a certain width while the rest of the surface portion 152 is made a little lower as shown in FIG. 3A, the sliding area of the titanium material within the groove 153 as well as the surface portion 152 left therearound against the surface portion 26 of the second mold 8 becomes smaller, so that the sliding resistance can be reduced and the mold life can be prolonged. Similar reduction in the sliding surface may naturally be applied to the second mold as well. Needless to say, this is also applicable to the pair of the second mold and the third mold.

Figure 3B:
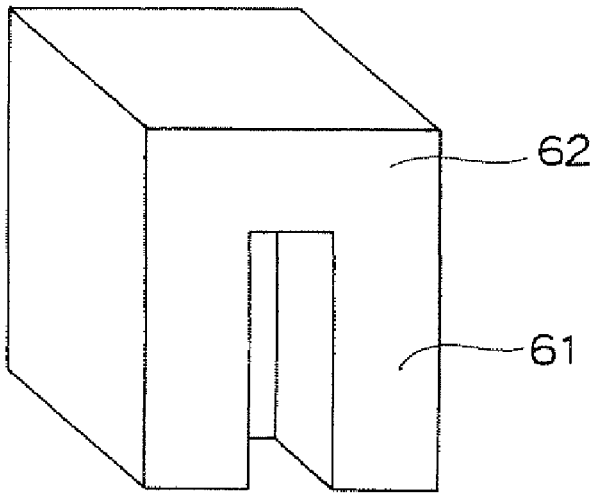
FIG. 3B is a perspective view showing part of a modification of the first mold.

Also, in the composite mold 1 of the first embodiment, the third mold 9 differs from the first mold 7 in that the body portion and the end portion are integrated in one unit, and that the through hole 18 for extraction of the dummy material 21 is included. However, the third mold may be identical to the first mold 7. In this case, the first mold 7 and the third mold 9 can be mass produced, so that the manufacturing cost for the composite mold can be reduced. Moreover, although the first mold 7 is so provided that its end portion 12 is fittable to and removable from the body portion 11 in the first embodiment, the first mold may also be formed so that its end portion 62 and body portion 61 are integrated in one unit as shown in FIG. 3B.

Also, in the composite mold 1 of the first embodiment, the groove 13 of the first mold 7 and the groove 23 of the third mold 9 are generally rectangular-shaped in their cross sections. However, at least one of the groove of the first mold and the groove of the third mold may also be formed into a cross-sectional shape other than the generally rectangular cross-sectional shape, such as generally semicircular cross-sectional shape or generally trapezoidal cross-sectional shape or the like.

Also, in the composite mold 1 of the first embodiment, the groove 13 of the first mold 7 and the through hole 24 of the second mold 8 generally perpendicularly intersect each other. However, in this invention, the groove of the first mold and the through hole of the second mold may intersect each other at an obtuse angle or an acute angle. Otherwise, their intersection may be of any form such as a rounded form as far as proper shear plastic deformation can be fulfilled.

Also, in the composite mold 1 of the first embodiment, the composite mold 1 is composed of three molds 7, 8, 9. However, in this invention, the mold may be composed of two molds or four or more molds. For example, in the mold of the first embodiment, with the second guide portion 16 of the second mold 8 and the third mold 9 omitted, the workpiece material such as titanium material pushed from the groove 13 of the first mold 7 into the through hole 24 of the second mold 8 may be extracted through an opening provided on one side of the through hole 24 opposite to the groove 13 side. In this case, needless to say, the workpiece material is subjected once to bending plastic deformation.

Also, in the composite mold 1 of the first embodiment, with the second mold 8 fixed, the first mold 7 is moved relative to the second mold 8. However, in this invention, it is also allowable that the first mold having a groove is fixed while the second mold having a through hole is moved relative to the first mold.

Also, in the composite mold 1 of the first embodiment, the first to third molds 7, 8, 9 are formed each into a generally rectangular parallelepiped shape. However, in this invention, it is also allowable that at least one of the first mold, the second mold and the third mold is formed into a shape other than the generally rectangular parallelepiped shape, such as a generally cylindrical shape or a generally prismatic shape other than a generally rectangular parallelepiped shape.

Also, in the composite mold 1 of the first embodiment, the side face portion of the first guide portion 15 for bending the titanium material 20 is provided so as to adjoin a side face of the through hole 24. However, the side face portion of the first guide portion for bending the workpiece material may be so provided as to adjoin a side face of the through hole of the second mold via a stepped portion. In this case, if the side face portion of the first guide portion for bending the workpiece material is located near the side face of the through hole of the second mold, then the workpiece material can be smoothly pushed from the groove of the first mold into the through hole of the second mold, preferably.

Also, in the composite mold 1 of the first embodiment, the through hole 24 is so provided as to extend generally linearly. However, in this invention, the through hole 24 may also be formed into a shape other than the generally linear shape, such as a bent shape or a curved shape. Still also, in the composite mold 1 of the first embodiment, the cross-sectional shape of the through hole 24 is a generally rectangular shape. However, the cross-sectional shape of the through hole may also be a shape other than the generally rectangular shape, such as a circular shape or a polygonal shape other than a quadrilateral shape. Further, in the first embodiment, the cross-sectional shape of the through hole 24 is constant toward the extending direction of the through hole 24. However, the cross-sectional shape of the through hole may also be varied toward the extending direction of the through hole.

Also, in the plastic working device of this embodiment, the retainer unit 2 is so constructed that the backup rollers 37, 38 are pressed by electric cylinders. However, it is also allowable that a toggle joint is placed between a backup roller and an electric cylinder to amplify the pressing force of the electric cylinder. Further, in the plastic working device of this embodiment, the first to third molds 7, 8, 9 are sandwiched by the backup rollers 37, 38. However, in this invention, the retainer unit may also be provided without using backup rollers. For example, it is also allowable that the first mold and the third mold are sandwiched directly by two electric cylinders so as to retain the fitting of the first mold and the second mold while retaining the fitting of the second mold and the third mold. Also, in the plastic working device of this embodiment, the retainer unit 2 has first and second electric cylinders. However, hydraulic cylinders may be used instead of the electric cylinders. The retainer unit may be implemented by any device only if one side face of the first mold in which the groove of the first mold is formed can be pressed against the third mold by the retainer unit and if one side face of the third mold in which the groove of the third mold is formed can be pressed against the first mold by the retainer unit. In addition, in the case where the composite mold is composed of two molds, it is needless to say that the retainer unit may be constructed in any way only if it is capable of retaining the fitting of the first mold and the second mold.

Also, in the plastic working device of this embodiment, the first relative movement unit is given by the preloading press 3, the second relative movement unit is the preloading press 5, and those which are used for pressure molding of concrete products are adopted as the preloading presses 3, 5. However, the preloading presses are not limited to those for use in pressure molding of concrete products. Further, the preloading presses that can be used in this invention may be those of the manual type (hand press, eccentric press), or the power-operated type (water-pressure press, hydraulic press, mechanical press), where plungers or the like may be used as the preloading presses as an example. In addition, the first relative movement unit and the second relative movement unit, needless to say, may be implemented by any devices only if those are capable of pressing (pushing) the molds.

Also, although the titanium material 20 made of pure titanium is adopted as the workpiece material in the first embodiment, yet workpiece materials to be treated for plastic working by the composite mold of this invention include materials made of pure metals other than materials made of pure titanium, such as materials made of pure iron, materials made of pure copper, materials made of pure aluminum, materials made of pure nickel, materials made of pure magnesium, materials made of pure silver, materials made of pure gold, and materials made of pure platinum. Further, other workpiece materials to be treated for plastic working by the composite mold of this invention include alloys made of a plurality of metals, as well as resin materials or synthetic resin materials such as vinyl chloride, silicon resin, styrene resin, acrylic resin, phenol resin, Gohsenol (registered trademark), Soarnol (registered trademark), and the like. Furthermore, ceramic materials, paste food materials and the like are also applicable. Needless to say, workpiece materials that can be subjected to plastic working by the composite mold of this invention may be any materials that are plastically deformable.

Figure 4A:
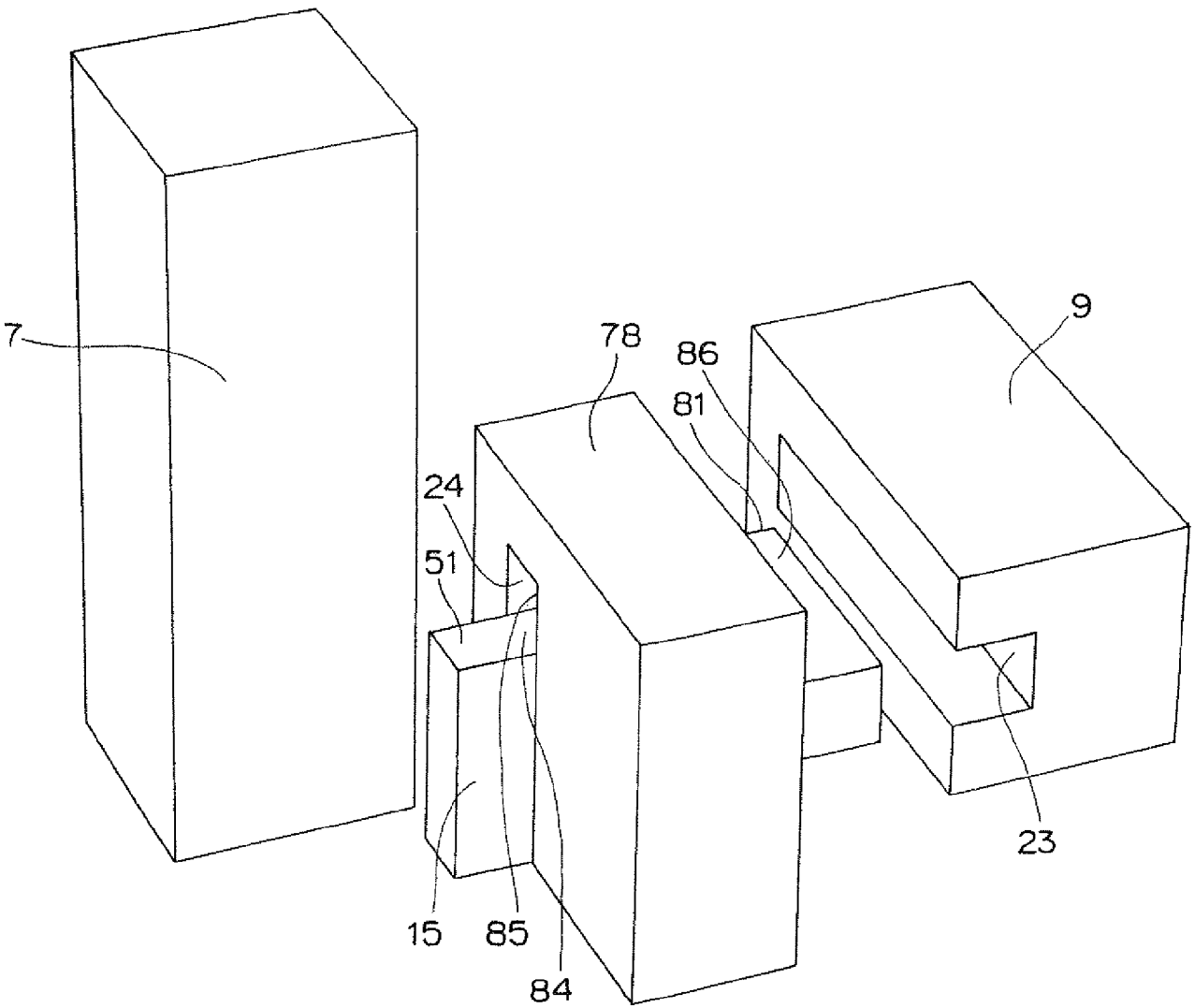
FIG. 4A is a perspective view showing part of a composite mold according to a second embodiment of the invention.
Figure 4B:
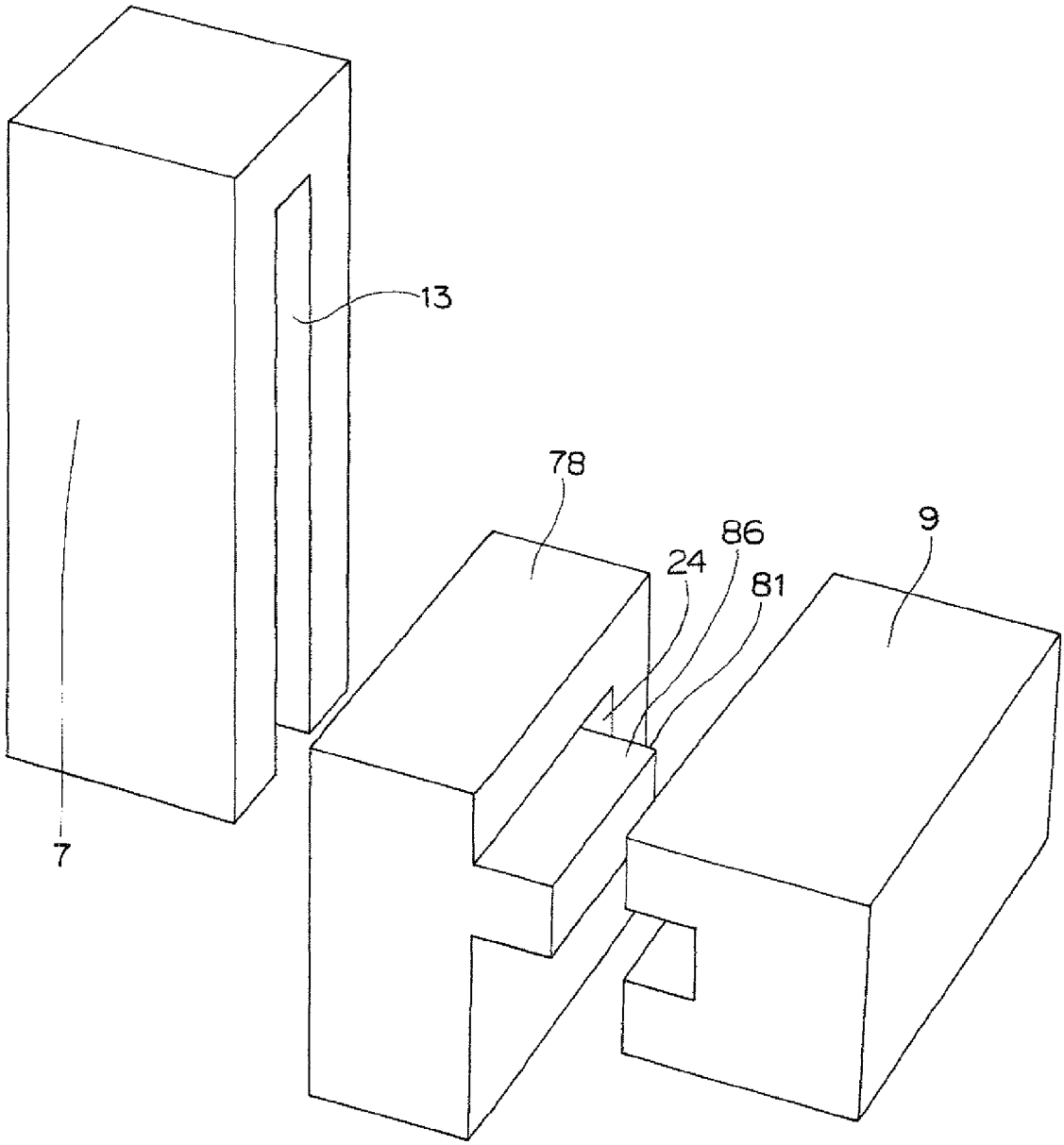
FIG. 4B is a perspective view showing part of the composite mold according to the second embodiment of the invention.

FIG. 4A is a perspective view showing part of a composite mold according to a second embodiment. FIG. 4B is a perspective view of part of the composite mold of the second embodiment as viewed in a direction different from that of FIG. 4A. The composite mold of the second embodiment differs from the composite mold 1 of the first embodiment only in the shape of a second mold 78. It is noted that FIGS. 4A and 4B, for a better understanding of the structure, show a state before the first to third molds 7, 78, 9 are fitted to one another so as to be integrated together. In FIGS. 4A and 4B, lines showing that an end portion of the first mold 7 is a removable type one are omitted for simplicity's sake.

With regard to the composite mold of the second embodiment, the same constituent members as those of the composite mold 1 of the first embodiment are designated by the same reference numerals, and their description is omitted. Also, for the composite mold of the second embodiment as well as for composite molds of the following third and fourth embodiments, functional effects and modifications common to those of the composite mold 1 of the first embodiment are not described, and their construction, functional effects and modifications different from those of the composite mold 1 of the first embodiment only are described.

As shown in FIGS. 4A and 4B, in the second embodiment, the second mold 78 has a larger width in a direction perpendicular to the extending direction of the through hole 24. Also in the second embodiment, the side face portion 51 for bending the workpiece material in the first guide portion 15 of the second mold 78, and a first portion 84 in one side face of the through hole 24, are positioned so as to be generally flush with each other, as in the first embodiment. However, the side face portion of the through hole 24 positioned generally flush with a portion 81 of the side face of a second guide portion 86 is not the first portion 84 as in the first embodiment, but a second portion 85 (right-hand side face portion of the first portion 84 in a plan view as viewed from the first guide portion 15 side) which is one of two portions generally perpendicular to the first portion 84 in the side face of the through hole 24, unlike the first embodiment.

According to the composite mold of the second embodiment, the workpiece material retained by the groove 13 of the first mold 7 can be easily pushed into the groove 23 of the third mold 9 via the through hole 24 of the second mold 78, and conversely, the workpiece material retained by the groove of the third mold 9 can be easily pushed into the groove 13 of the first mold 7 via the through hole 24.

In addition, in the composite mold of the second embodiment, the side face portion 51 for bending the workpiece material in the first guide portion 15 of the first mold 7, and the first portion 84 in one side face of the through hole 24, are positioned so as to be generally flush with each other, and moreover the portion 81 of the side face of the second guide portion 86 and the second portion 85 generally perpendicular to the first portion 84 in the side face of the through hole 24 are positioned so as to be generally flush with each other. However, in the case where the cross-sectional shape of the through hole of the second mold is a generally rectangular shape, it is also allowable, as a third embodiment of the composite mold of the invention, that the side face portion for bending the workpiece material in the first guide portion and the first portion in one side face of the through hole are positioned so as to be generally flush with each other while a portion of the side face of the second guide portion and the other one portion out of two portions generally perpendicular to the first portion in the side face of the through hole (a side face portion on the left hand of the first portion in a plan view as viewed from the first guide portion side) are positioned so as to be generally flush with each other.

Also in the case where the cross-sectional shape of the through hole of the second mold is a generally rectangular shape, it is also allowable, as a fourth embodiment of the composite mold of the invention, that the side face portion for bending the workpiece material in the first guide portion and the first portion in one side face of the through hole are positioned so as to be generally flush with each other while a portion of one side face of the second guide portion and the second portion of a side face of the through hole generally parallel to the first portion are positioned so as to be generally flush with each other.

Figure 5A:
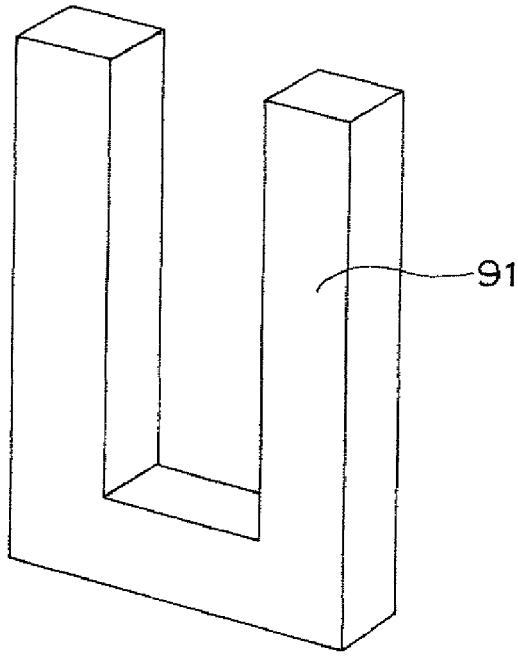
FIG. 5A is a perspective view showing a shape of a workpiece material which is being extruded from the groove of the first mold to a groove of a third mold in the composite mold of the first embodiment of the invention.
Figure 5B:
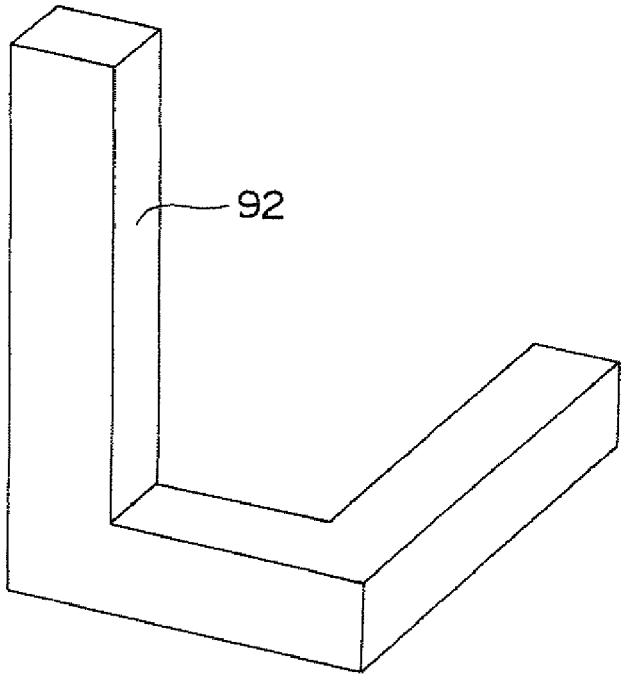
FIG. 5B is a perspective view showing a shape of a workpiece material which is being extruded from a groove of a first mold to a groove of a third mold in the composite mold of the second embodiment of the invention.
Figure 5C:
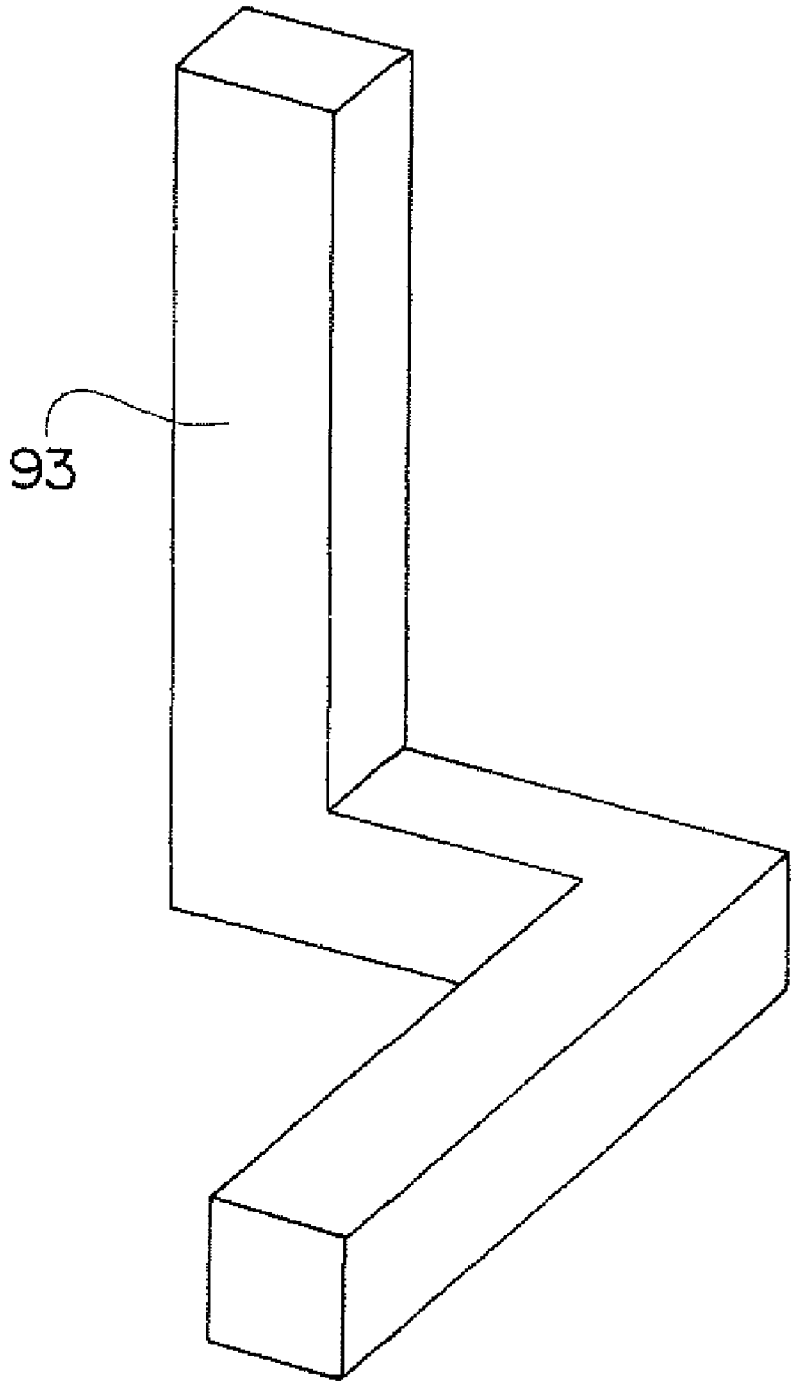
FIG. 5C is a perspective view showing a shape of a workpiece material which is being extruded from a groove of a first mold to a groove of a third mold in a composite mold of a third embodiment of the invention.
Figure 5D:
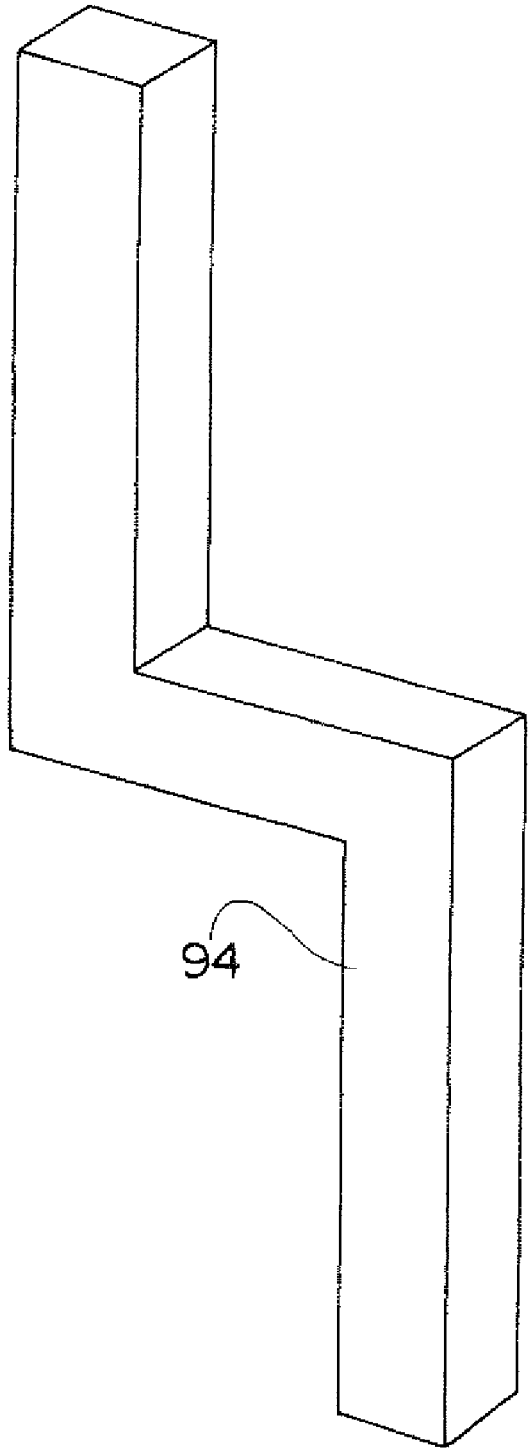
FIG. 5D is a perspective view showing a shape of a workpiece material which is being extruded from a groove of a first mold to a groove of a third mold in a composite mold of a fourth embodiment of the invention.

FIG. 5A is a perspective view showing a shape of a workpiece material 91 which is being extruded from the groove 13 of the first mold 7 to the groove 23 of the third mold 9 in the composite mold 1 of the first embodiment. FIG. 5B is a perspective view showing a shape of a workpiece material 92 which is being extruded from the groove 13 of the first mold 7 to the groove 23 of the third mold 9 in the composite mold of the second embodiment. FIG. 5C is a perspective view showing a shape of a workpiece material 93 which is being extruded from the groove of the first mold to the groove of the third mold in the composite mold of the third embodiment. Also, FIG. 5D is a perspective view showing a shape of a workpiece material 94 which is being extruded from the groove of the first mold to the groove of the third mold in the composite mold of the fourth embodiment.

As shown in FIGS. 5A to 5D, it can be understood that every one of the workpiece materials 91, 92, 93, 94 is bent about 90 degrees at two points, and that the workpiece material 91, 92, 93, 94, when extruded from the first mold to the third mold, is subjected to severe plastic deformation twice in most part of the workpiece material 91, 92, 93, 94 except its one end portion.

As described in detail hereinabove, in the composite molds of the first to fourth embodiments, the workpiece material can be easily reciprocated a desired number of times between the groove of the first mold and the groove of the third mold, where if the number of times of reciprocation is n (where n is a natural number), then the workpiece material 91, 92, 93, 94 can be subjected to severe plastic deformation 4n times in most part except its both end portions. Therefore, by properly adjusting the number of times of reciprocation in accordance with intended use, strength and durability of the workpiece material can be easily controlled to desired values in accordance with the use.

In addition, needless to say, in the plastic working device of this embodiment, plastic working devices of embodiments different from the plastic working device of the first embodiment can be easily provided by replacing the composite mold 1 with the composite mold according to the modification of the first embodiment, the composite mold of the second embodiment, the composite mold of the third embodiment, or the composite mold of the fourth embodiment. Furthermore, the plastic working device may have a heating device such as a heater. In this case, the plastic working device of this embodiment is, needless to say, enabled to heat a workpiece material as well as mold parts and the like to temperatures that optimize the micro-fining efficiency of crystal grain size by shearing in accordance with properties of the workpiece material.

What is claimed is:

1. A composite mold comprising:

a first mold having a groove which retains a generally linear-shaped workpiece material and which is formed at least partly into a generally linear shape;

a second mold which has a first guide portion to be relatively movably fitted to the groove, and which has a body portion having a through hole intersecting and communicating with the groove, wherein with the first guide portion fitted to the groove, the first mold and the second mold are movable relative to each other in a generally linearly extending direction of the groove, and the first guide portion acts so that the workpiece material substantially immovably retained in the groove of the first mold is bent and guided from the groove to the through hole by relative movement of the first mold to the second mold; and a third mold having a groove which retains the generally linear-shaped workpiece material and which is formed at least partly into a generally linear shape, wherein the second mold has a second guide portion to be relatively movably fitted to the groove of the third mold, and the groove of the third mold communicates with an opening of the through hole on its one side opposite to a first mold side.

2. The composite mold as claimed in claim 1, wherein the groove of the first mold, a surface of the second mold on one side confronting the groove, and the first guide portion form a closed space that closes widthwise directions and at least longitudinal one end of the generally linear-shaped workpiece material, and a surface of the first guide portion confronting the closed space adjoins a side face of the through hole or is located near the side face.

3. The composite mold as claimed in claim 2, wherein an end corner of the surface of the second mold on one side confronting the groove and opposite to a through hole side in the extending direction of the groove is machined for chamfering.

4. The composite mold as claimed in claim 1, wherein with the first guide portion fitted to the groove, a portion of the groove communicating with the through hole is constantly covered with the surface of the second mold confronting the groove.

5. The composite mold as claimed in claim 1, wherein the first guide portion is a protruding portion that protrudes from the body portion, and a side face portion of the first guide portion for bending the workpiece material is an extension surface of part of a side face of the through hole.

6. The composite mold as claimed in claim 5, wherein the through hole extends generally linearly, and an extending direction of the groove generally perpendicularly intersects the extending direction of the through hole.

7. The composite mold as claimed in claim 1, wherein the second guide portion is a protruding portion that protrudes from the body portion.

8. The composite mold as claimed in claim 7, wherein part of a side face of the second guide portion is an extension surface of part of a side face of the through hole.

9. The composite mold as claimed in claim 7, wherein the through hole extends generally linearly and has a generally rectangular cross-sectional shape, a side face portion of the first guide portion for bending the workpiece material and a first portion of a side face of the through hole are positioned generally flush with each other, and part of a side face of the second guide portion and a second portion of a side face of the through hole generally perpendicular to the first portion are generally flush with each other.

10. The composite mold as claimed in claim 7, wherein the through hole extends generally linearly and has a generally rectangular cross-sectional shape, and a side face portion of the first guide portion for bending the workpiece material and a first portion of a side face of the through hole are positioned generally flush with each other, and part of a side face of the second guide portion and a second portion of a side face of the through hole generally parallel to the first portion are generally flush with each other.

11. The composite mold as claimed in claim 1, wherein the through hole is generally constant in cross-sectional shape and extends generally linearly, the second mold is so shaped as to be generally plane symmetrical with respect to a perpendicular bisector plane of the through hole that stretches along a direction perpendicular to the extending direction of the through hole, and the first mold and the third mold are generally identical in shape to each other.

12. The composite mold as claimed in claim 11, wherein the through hole has a generally rectangular cross-sectional shape, and a side face portion of the first guide portion for bending the workpiece material, part of a side face of the through hole (24), and part of a side face of the second guide portion are generally flush with one another.

13. The composite mold as claimed in claim 12, wherein the first guide portion is generally rectangular parallelepiped-shaped, and a cross section of the groove of the first mold perpendicular to the extending direction of the groove has a generally rectangular cross-sectional shape.

14. The composite mold as claimed in claim 1, wherein the first mold has a body portion in which the groove is formed, and an end portion which adjoins the body portion in an extending direction of the groove and which covers one end of the groove, and the workpiece material is substantially immovably retained in the groove of the first mold by an end face of the end portion facing the groove.

15. The composite mold as claimed in claim 14, wherein the end portion is fittable to and removable from the body portion of the first mold.

16. The composite mold as claimed in claim 1 wherein the through hole extends generally linearly, and a cross-sectional shape of the groove of the first mold, a cross-sectional shape of the through hole, and a cross-sectional shape of the groove of the third mold are generally identical to one another.

17. The composite mold as claimed in claim 16, wherein an extending direction of the groove of the first mold and an extending direction of the groove of the third mold generally perpendicularly intersect with an extending direction of the through hole.

18. A plastic working device for workpiece material, comprising:

a first mold having a groove which retains a workpiece material and which is formed at least partly into a generally linear shape;

a second mold which has a first guide portion to be relatively movably fitted to the groove, and which has a body portion having a through hole intersecting and communicating with the groove;

a first relative movement unit for moving the first mold and the second mold relative to each other so that the workpiece material substantially immovably retained in the groove of the first mold is pushed from the groove into the through hole;

a retainer unit for retaining a state that the first guide portion is fitted to the groove of the first mold;

a third mold having a groove which retains the workpiece material and which intersects and communicates with the through hole and moreover which is formed at least partly into a generally linear shape, wherein the second mold has a second guide portion to be relatively movably fitted to the groove of the third mold; and a second relative movement unit for moving the second mold and the third mold relative to each other, wherein the retainer unit retains a state that the second guide portion is fitted to the groove of the third mold.

19. The plastic working device for workpiece material as claimed in claim 18, wherein the second mold is immobilized, and the first relative movement unit is a pressing device for pressing the first mold so that the workpiece material retained in the groove of the first mold is pressed against the first guide portion.

20. The plastic working device for workpiece material as claimed in claim 18, wherein the second mold (8) is immobilized, and the first relative movement unit presses the first mold so that part of the groove of the first mold communicating with the through hole is shrunk, while the second relative movement unit presses the third mold so that part of the groove of the third mold communicating with the through hole is shrunk, and a pressing force with which the first relative movement unit presses the first mold is set larger than a pressing force with which the second relative movement unit presses the third mold, whereby the workpiece material retained in the groove of the first mold is moved to the groove of the third mold via the through hole, and the pressing force with which the first relative movement unit presses the first mold is set smaller than the pressing force with which the second relative movement unit presses the third mold, whereby the workpiece material retained in the groove of the third mold is moved to the groove of the first mold via the through hole.

21. A plastic working method for workpiece material, comprising:

a workpiece material retaining step for retaining a workpiece material in part of a groove of a first mold, the groove being for retaining the workpiece material and being formed at least partly into a generally linear shape;

a first fitting step for fitting a first guide portion of a second mold to a place of the groove where the workpiece material is not placed, the second mold having the first guide portion to be relatively movably fitted to the groove, and further having a body portion having a through hole intersecting and communicating with the groove with the first guide portion fitted to the groove;

a workpiece material push-in step for making the first mold moved relative to the second mold with the first guide portion fitted to the groove so that the workpiece material substantially immovably retained in the groove of the first mold is bent by the first guide portion and pushed from the groove into the through hole, wherein the second mold has a second guide portion;

a second fitting step for fitting the second guide portion of the second mold to a groove of a third mold, the third mold having the groove to which the second guide portion is to be fitted and which is to communicate with the through hole with the second guide portion fitted to the groove and moreover which is formed at least partly into a generally linear shape; and a retaining step for retaining a state that the first guide portion is fitted to the groove of the first mold while the second guide portion is fitted to the groove of the third mold, wherein in the workpiece material push-in step, at least part of the workpiece material is pushed into the groove of the third mold via the through hole.

* * * * *